US012605643B2

(12) United States Patent
Chen

(10) Patent No.: US 12,605,643 B2
(45) Date of Patent: Apr. 21, 2026

(54) MAGNETIC BUILDING BLOCK

(71) Applicant: Peixia Chen, Shenzhen (CN)

(72) Inventor: Peixia Chen, Shenzhen (CN)

( * ) Notice: Subject to any disclaimer, the term of this patent is extended or adjusted under 35 U.S.C. 154(b) by 0 days.

(21) Appl. No.: 18/431,497

(22) Filed: Feb. 2, 2024

(65) Prior Publication Data

US 2025/0041753 A1 Feb. 6, 2025

Related U.S. Application Data

(63) Continuation-in-part of application No. 18/449,094, filed on Aug. 14, 2023, now Pat. No. 12,151,182.

(30) Foreign Application Priority Data

Aug. 1, 2023 (CN) ..... 202322068828.8

(51) Int. Cl.
*A63H 33/04* (2006.01)

(52) U.S. Cl.
CPC ..... *A63H 33/046* (2013.01)

(58) Field of Classification Search
CPC ..... A63H 33/046; A63H 33/26
USPC ..... 446/92, 129, 132, 133
See application file for complete search history.

(56) References Cited

U.S. PATENT DOCUMENTS 3,601,921 A * 8/1971 Strohmaier ..... A63H 33/046 446/92
5,458,522 A * 10/1995 Brooks, III ..... A63H 33/048 446/85
6,024,626 A * 2/2000 Mendelsohn ..... A63H 33/046 446/124
6,749,480 B1 * 6/2004 Hunts ..... A63H 33/046 446/85
7,255,624 B2 * 8/2007 Daftari ..... A63H 33/22 446/485
8,128,452 B2 * 3/2012 Kim ..... A63H 33/046 446/92
9,751,025 B2 * 9/2017 Kiribuchi ..... A63H 33/046
9,873,062 B2 * 1/2018 Purns ..... A63H 33/06
11,103,801 B2 * 8/2021 Vicentelli ..... A63H 33/06
11,207,609 B2 * 12/2021 Rosen ..... A63H 33/046
11,224,821 B2 * 1/2022 Rosen ..... H01F 7/0221
11,406,909 B2 * 8/2022 Zhang ..... A63H 33/26
11,458,410 B2 * 10/2022 Xu ..... A63H 33/046
11,766,622 B1 * 9/2023 Chen ..... A63H 33/046 446/92
2007/0037469 A1 * 2/2007 Yoon ..... A63H 33/046 446/92
2012/0270465 A1 * 10/2012 Park ..... A63H 33/046 206/338
2012/0309259 A1 * 12/2012 Mak ..... A63H 33/046 446/92
2015/0065007 A1 * 3/2015 Klepper ..... A63H 33/046 446/92
2015/0258462 A1 * 9/2015 Wei ..... A63H 33/06 446/92

(Continued)

*Primary Examiner* — Joseph B Baldori

(57) ABSTRACT

The present disclosure provides a magnetic building block. Furthermore, the stop assembly is separated into the upper stop part and the lower stop part by the partition plate part, so that the strength of the stop assembly can be improved. The upper stop part may stop the first magnet part at the first compartment part, and the lower stop part may stop the second magnet part at the second compartment part.

8 Claims, 17 Drawing Sheets

(56) References Cited

U.S. PATENT DOCUMENTS

| | | | | |
|---|---|---|---|---|
| 2016/0199749 | A1* | 7/2016 | Whittaker | A63H 33/046<br>434/278 |
| 2018/0056204 | A1* | 3/2018 | Knudsen | A63H 33/046 |
| 2019/0201804 | A1* | 7/2019 | Khalus | A63H 33/046 |
| 2020/0406156 | A1* | 12/2020 | Rosen | A63H 33/042 |

* cited by examiner

MAGNETIC BUILDING BLOCK

CROSS-REFERENCE TO RELATED APPLICATIONS

This application is a Continuation in Part of the U.S. application Ser. No. 18/449,094 filed on Aug. 14, 2023, and entitled "MAGNETIC SUCTION BUILDING BLOCK", now pending, and this application also claims priority of Chinese patent application CN202322068828.8, filed on Aug. 1, 2023, the entire disclosures of which are incorporated herein by reference.

TECHNICAL FIELD

The present disclosure relates to the field of building blocks, and in particular, to a magnetic building block.

BACKGROUND

As a toy that has become increasingly popular in recent years, a 3D magnetic suction intellective building block may be used to establish a three-dimensional shape and help develop children's imagination. The existing magnetic suction building block on the current market has single stacking angles, usually the magnetic suction building block may be stacked on a same axis, and the playing method is simple, so more connecting modes cannot be implemented. For example, the design and building of a misplaced modeling cannot be implemented, so the children's interest in building and modeling is greatly influenced. Therefore, it is urgent to provide a magnetic suction building block with various stacking angles, more connecting modes and rich playing methods on the market, so as to implement the design and building of the misplaced modeling, improve the children's interest in building and modeling and help develop the children's imagination.

SUMMARY

In order to overcome the shortcomings of the prior art, the present disclosure provides a magnetic building block, including:

a building block main body, including a first surrounding wall group formed by connecting a plurality of surrounding walls end to end in sequence, an upper side wall connected to an upper end of the first surrounding wall group, a lower side wall connected to a lower end of the first surrounding wall group, at least one supporting wall connected to an inner side of the first surrounding wall group, a partition plate part, and a stop assembly, wherein a first compartment part is formed between an upper side of the supporting wall and the inner side of the first surrounding wall group, and a second compartment part is formed between a lower side of the supporting wall and the inner side of the first surrounding wall group;

a first crossed corner is formed at a joint between an upper end of the first surrounding wall group and the upper side wall, and a second crossed corner is formed at a joint between the lower end of the first surrounding wall group and the lower side wall; the first compartment is arranged at the first crossed corner, and the second compartment is arranged at the second crossed corner;

a first magnet part and a second magnet part, wherein the first magnet part is arranged inside the first compartment part, and the first magnet part is able to rotate in the first compartment part; the first magnet part is provided with an N pole and an S pole; the second magnet part is arranged inside the second compartment part, and the second magnet part is able to rotate in the second compartment part; the first magnet part and the second magnet part are both provided with an N pole and an S pole;

the partition plate part is connected to an inner surface of the first surrounding wall group, and the partition plate part is located between the upper side wall and the lower side wall;

the stop assembly includes an upper stop part and a lower stop part; a lower side of the upper stop part is connected to an upper surface of the partition plate part; an upper side of the upper stop part is configured to stop the first magnet part inside the first compartment part; an upper side of the lower stop part is connected to a lower surface of the partition plate part; and a lower side of the lower stop part is configured to stop the second magnet part inside the second compartment part.

As the improvement of the present disclosure, the partition plate part, the first surrounding wall group, the supporting wall, the upper stop part, and the lower stop part are integrally formed.

As the improvement of the present disclosure, a length of the upper stop part is greater than a length of the lower stop part.

As the improvement of the present disclosure, several reinforcing ribs are arranged on the upper surface of the partition plate in a protruding manner, and the reinforcing ribs are connected to the lower side of the upper stop part.

As the improvement of the present disclosure, the upper surface of the partition plate part extends to form several first positioning pillars; first positioning holes are arranged on the first positioning pillars; an inner surface of the upper side wall extends to form a second positioning pillar; and the second positioning pillar is inserted into the first positioning holes.

As the improvement of the present disclosure, the lower surface of the partition plate part extends to form several third positioning pillars; second positioning holes are arranged on the third positioning pillars; the inner surface of the upper side wall extends to form a fourth positioning pillar; and the fourth positioning pillar is inserted into the second positioning holes.

As the improvement of the present disclosure, the supporting wall includes a first inner wall group, wherein the first inner wall group is connected to the inner surface of the first surrounding wall group; the first inner wall group and the inner surface of the first surrounding wall group are encircled to form a mounting slot group; the mounting slot group is arranged between the first compartment part and the second compartment part; a second inner wall group, wherein the second inner wall group is connected to an inner surface of the upper side wall; the second inner wall group and the inner surface of the upper side wall form the first compartment part; the first compartment part is communicated to the mounting slot group; and a third inner wall group, wherein the third inner wall group is connected to an inner surface of the lower side wall; the third inner wall group and the inner surface of the lower side wall form the second compartment part; and the second compartment part is communicated to the mounting slot group.

As the improvement of the present disclosure, the partition plate part, the first surrounding wall group, the first inner wall group, the second inner wall group, the third inner wall group, the upper stop part, and the lower stop part are integrally formed.

As the improvement of the present disclosure, the building block main body is a square building block main body; the square building block main body is provided with six side walls, which include a front side wall, a rear side wall, a left side wall, a right side wall, an upper side wall, and a lower side wall; the front side wall, the rear side wall, the left side wall, and the right side wall are connected in sequence to form the first surrounding wall group; a right side of the front side wall is connected to the right side wall; upper sides of the front side wall and the right side wall are both connected to the upper side wall; lower sides of the front side wall and the right side wall are both connected to the lower side wall; a left side of the front side wall is connected to the left side wall; upper sides of the front side wall and the left side wall are both connected to the upper side wall; lower sides of the front side wall and the left side wall are both connected to the lower side wall; a left side of the rear side wall is connected to the right side wall; upper sides of the rear side wall and the right side wall are both connected to the upper side wall; lower sides of the rear side wall and the right side wall are both connected to the lower side wall; a right side of the rear side wall is connected to the left side wall; upper sides of the rear side wall and the left side wall are both connected to the upper side wall; and lower sides of the rear side wall and the left side wall are both connected to the lower side wall.

As the improvement of the present disclosure, the first crossed corner part includes a first crossed corner unit arranged at a joint among the front side wall, the right side wall, and the upper side wall, a third crossed corner unit arranged at a joint among the front side wall, the left side wall, and the upper side wall, a fifth crossed corner unit arranged at a joint among the rear side wall, the right side wall, and the upper side wall, and a seventh crossed corner unit arranged at a joint among the rear side wall, the left side wall, and the upper side wall; the second crossed corner part includes a second crossed corner unit arranged at a joint among the front side wall, the right side wall, and the lower side wall, a fourth crossed corner unit arranged at a joint among the front side wall, the left side wall, and the lower side wall, a sixth crossed corner unit arranged at a joint among the rear side wall, the right side wall, and the lower side wall, and an eighth crossed corner unit arranged at a joint among the rear side wall, the left side wall, and the lower side wall; the first compartment part includes a first compartment unit arranged at the first crossed corner unit, a third compartment unit arranged at the third crossed corner unit, a fifth compartment unit arranged at the fifth crossed corner unit, and a seventh compartment unit arranged at the seventh crossed corner unit; the second compartment part includes a second compartment unit arranged at the second crossed corner unit, a fourth compartment unit arranged at the fourth crossed corner unit, a sixth compartment unit arranged at the sixth crossed corner unit, and an eighth compartment unit arranged at the eighth crossed corner unit; the first magnet part includes a first magnet unit arranged at the first compartment unit, a third magnet unit arranged at the third compartment unit, a fifth magnet unit arranged at the fifth compartment unit, and a seventh magnet unit arranged at the seventh compartment unit; the second magnet part includes a second magnet unit arranged at the second compartment unit, a fourth magnet unit arranged at the fourth compartment unit, a sixth magnet unit arranged at the sixth compartment unit, and an eighth magnet unit arranged at the eighth compartment unit; the mounting slot group includes a first mounting slot arranged between the first compartment unit and the second compartment unit, a second mounting slot arranged between the third compartment unit and the fourth compartment unit, a third mounting slot arranged between the fifth compartment unit and the sixth compartment unit, and a fourth mounting slot arranged between the seventh compartment unit and the eighth compartment unit; the stop assembly is a stop pillar assembly; the upper stop part is an upper stop pillar part, and the lower stop part is a lower stop pillar part; the stop assembly includes a first stop pillar, a second stop pillar, a third stop pillar, and a fourth stop pillar; the first stop pillar is arranged in the first mounting slot; the second stop pillar is arranged in the second mounting slot; the third stop pillar is arranged in the third mounting slot; the fourth stop pillar is arranged in the fourth mounting slot; an upper side of the first stop pillar stops the first magnet unit inside the first compartment unit, and a lower side of the first stop pillar stops the second magnet unit inside the second compartment unit; an upper side of the second stop pillar stops the third magnet unit inside the third compartment unit, and a lower side of the second stop pillar stops the fourth magnet unit inside the fourth compartment unit; an upper side of the third stop pillar stops the fifth magnet unit inside the fifth compartment unit, and a lower side of the third stop pillar stops the sixth magnet unit inside the sixth compartment unit; and an upper side of the fourth stop pillar stops the seventh magnet unit inside the seventh compartment unit, and a lower side of the fourth stop pillar stops the eighth magnet unit inside the eighth compartment unit.

The present disclosure has the following beneficial effects. The present disclosure provides a magnetic building block. The magnetic building block includes: a building block main body, including a first surrounding wall group formed by connecting a plurality of surrounding walls end to end in sequence, an upper side wall connected to an upper end of the first surrounding wall group, a lower side wall connected to a lower end of the first surrounding wall group, at least one supporting wall connected to an inner side of the first surrounding wall group, a partition plate part, and a stop assembly, wherein a first compartment part is formed between an upper side of the supporting wall and the inner side of the first surrounding wall group, and a second compartment part is formed between a lower side of the supporting wall and the inner side of the first surrounding wall group;

a first crossed corner is formed at a joint between an upper end of the first surrounding wall group and the upper side wall, and a second crossed corner is formed at a joint between the lower end of the first surrounding wall group and the lower side wall; the first compartment is arranged at the first crossed corner, and the second compartment is arranged at the second crossed corner;

a first magnet part and a second magnet part, wherein the first magnet part is arranged inside the first compartment part, and the first magnet part is able to rotate in the first compartment part; the first magnet part is provided with an N pole and an S pole; the second magnet part is arranged inside the second compartment part, and the second magnet part is able to rotate in the second compartment part; first magnet part and the second magnet part are both provided with an N pole and an S pole;

the partition plate part is connected to an inner surface of the first surrounding wall group, and the partition plate part is located between the upper side wall and the lower side wall;

the stop assembly includes an upper stop part and a lower stop part; a lower side of the upper stop part is connected to an upper surface of the partition plate part; an upper side of the upper stop part is configured to stop the first magnet part inside the first compartment part; an upper side of the lower stop part is connected to a lower surface of the partition plate part; and a lower side of the lower stop part is configured to stop the second magnet part inside the second compartment part.

Through the above structure, the magnetic building blocks may attract each other through the first magnet part arranged at the first compartment part at the first crossed corner and the second magnet part arranged at the second compartment part at the second crossed corner, so that the magnetic building blocks may be mutually connected at the crossed corners, thereby achieving the misplaced connection among the magnetic building blocks and achieving the design and building of misplaced shapes. Compared with the magnetic building blocks that can only be stacked on the same axis in the existing technology, the present disclosure has the advantages that the building mode and playing method of the magnetic building block provided by the present disclosure are greatly enriched, so as to help children build more shapes, and various pattern combinations may be built in combination with surface patterns of the magnetic building blocks, so as to greatly improve children's interest in modeling and help develop children's imagination. Further, since the first magnet part may rotate in the first compartment part and the second magnet part may rotate in the second compartment part, and the first magnet part and the second magnet part are both provided with the N poles and the S poles, when the magnetic building blocks are mutually stacked at the crossed corners, the first magnet part and the second magnet part of the magnetic building block may easily guide the N pole of the magnetic building block to be tightly absorbed with the S pole of another same magnetic building block by the rotation, or guide the S pole of the magnetic building block to be tightly absorbed with the N pole of another same magnetic building block by the rotation, so as to achieve a stable connection among the magnetic building blocks, achieve the misplaced connection among the magnetic building blocks, and achieve the design and building of the misplaced shapes. The building block main body may be in a shape of a triangular prism or rectangular pyramid, or may be in a shape of a triangular prism, rectangular pyramid, pentagonal prism or hexagonal prism or another shape. It should be noted that only illustrate several different shapes of the building block, and do not illustrate other structures. Furthermore, the stop assembly is separated into the upper stop part and the lower stop part by the partition plate part, so that the strength of the stop assembly can be improved. The upper stop part may stop the first magnet part at the first compartment part, and the lower stop part may stop the second magnet part at the second compartment part.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Embodiment I

Figure 1:
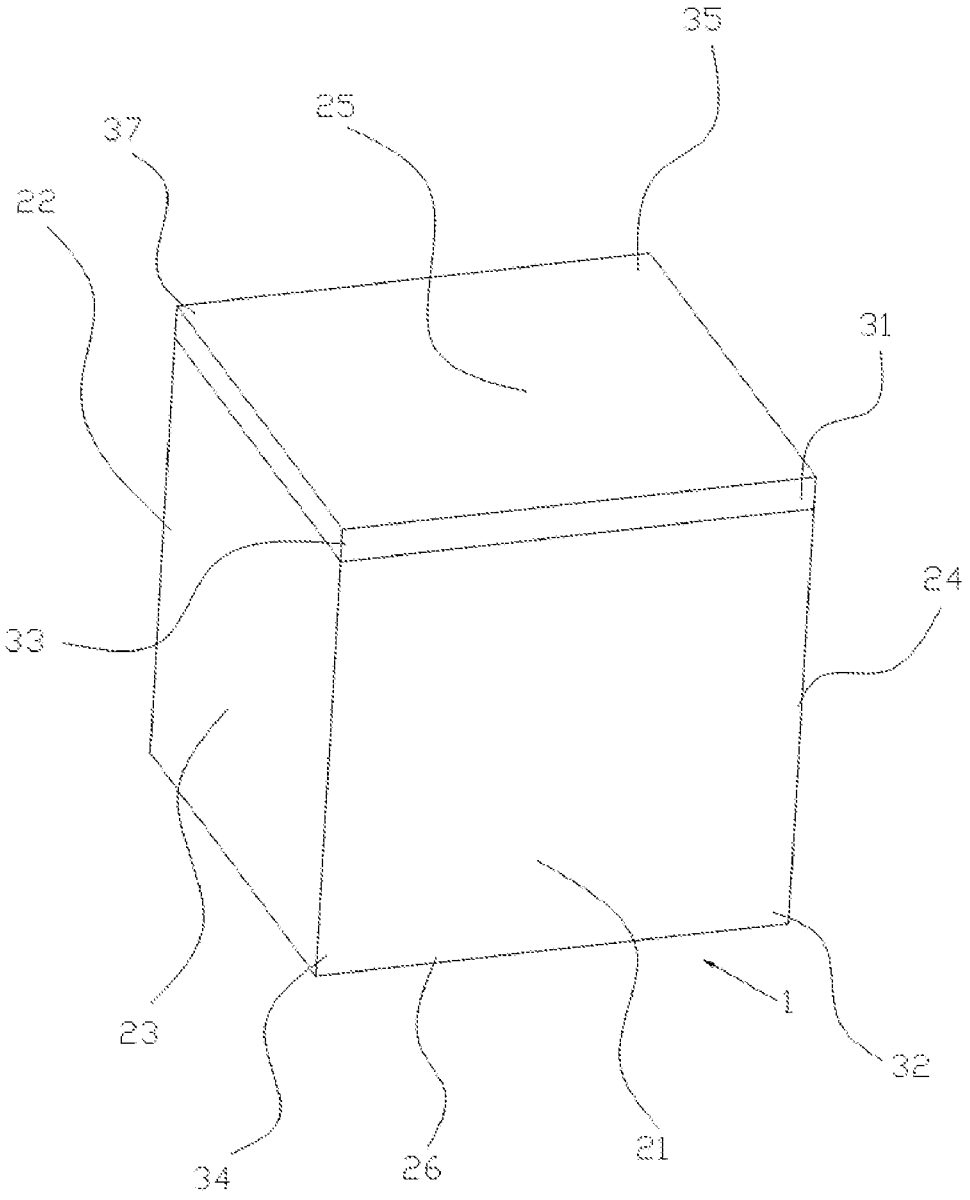
FIG. 1 is a schematic diagram of an entire structure of the present disclosure.
Figure 2:
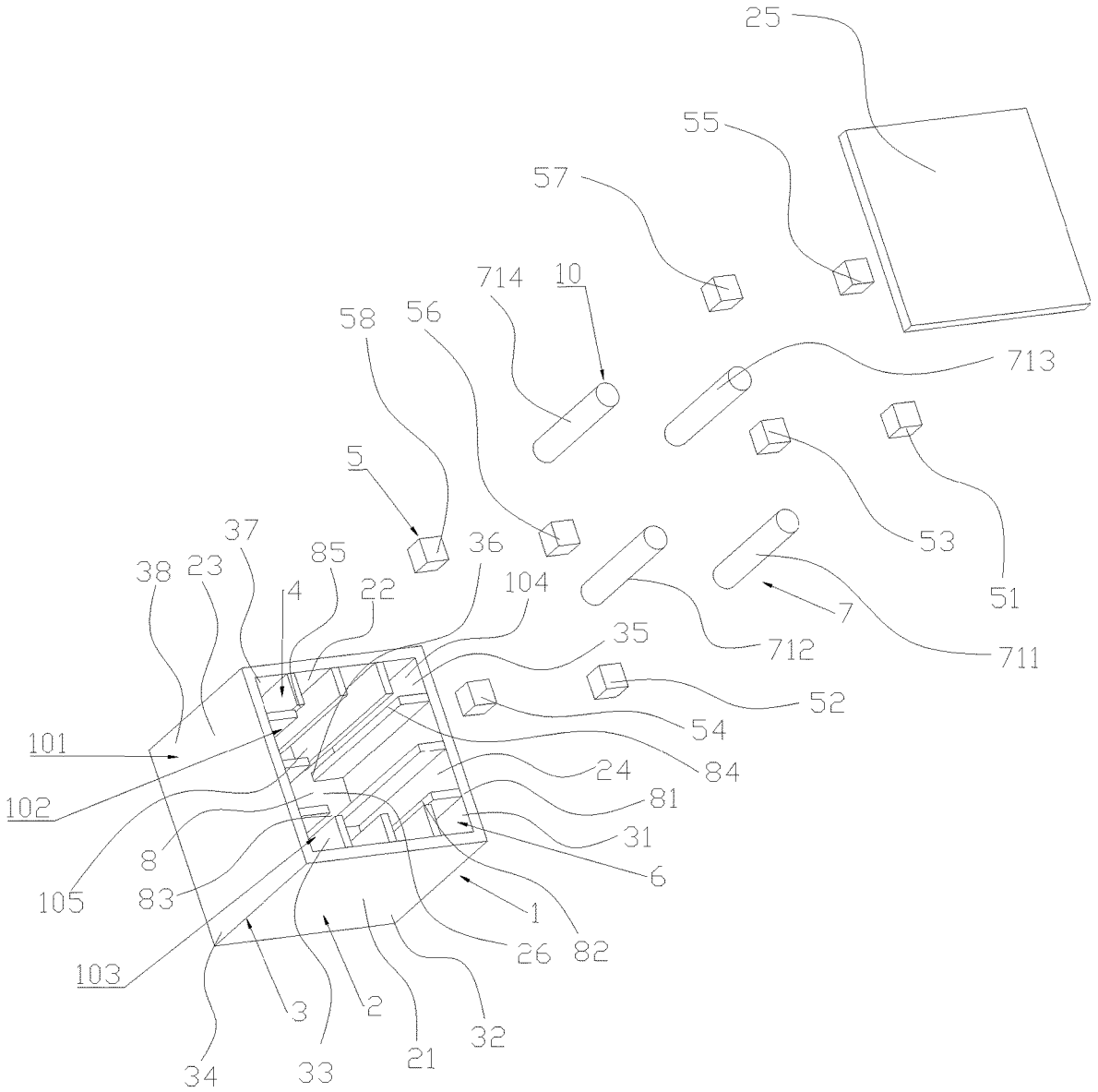
FIG. 2 is an exploded view of Embodiment I of the present disclosure.
Figure 10:
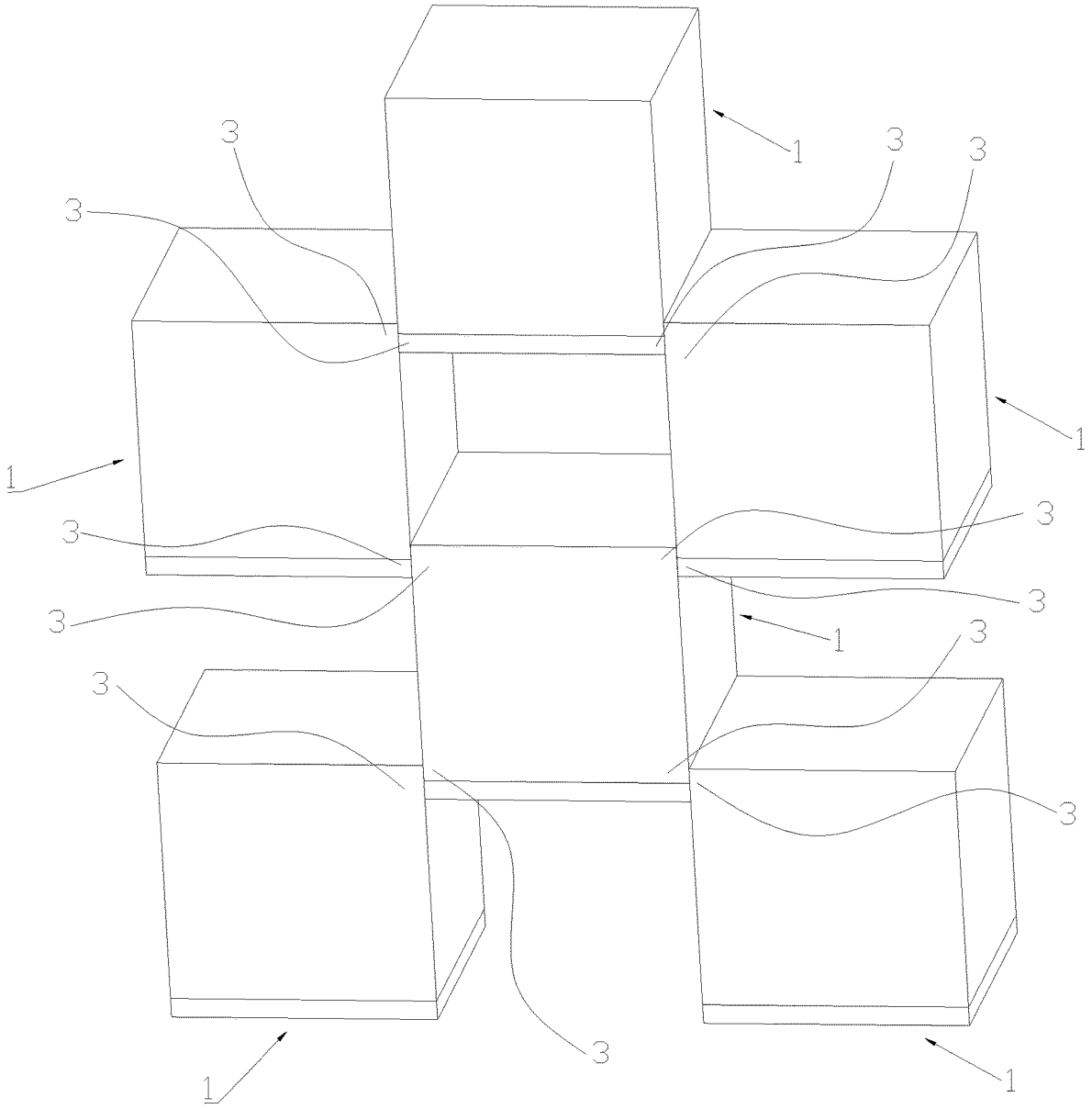
FIG. 10 is a schematic diagram of an overall structure of a misplaced shape formed by building when magnetic toys are mutually connected at crossed corners according to the present disclosure.
Figure 11:
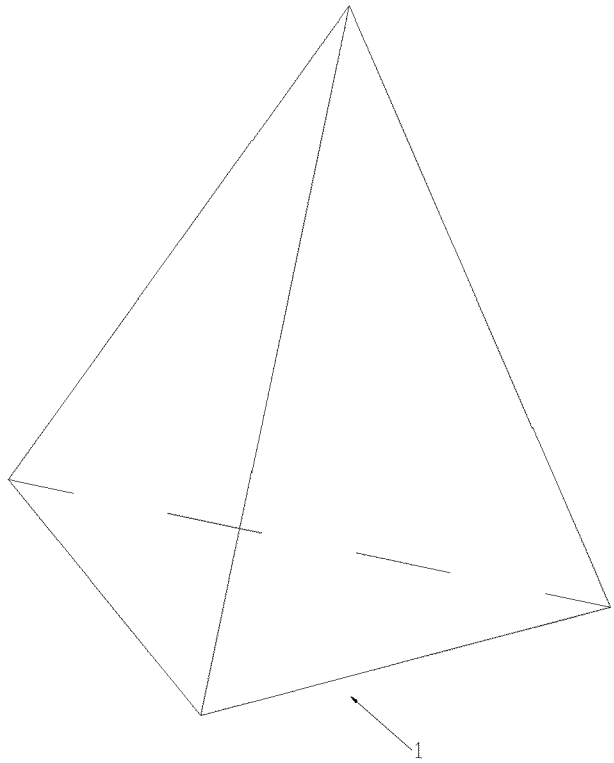
FIG. 11 is a schematic structural diagram when a building block main body is a triangular pyramid shape according to the present disclosure.
Figure 12:
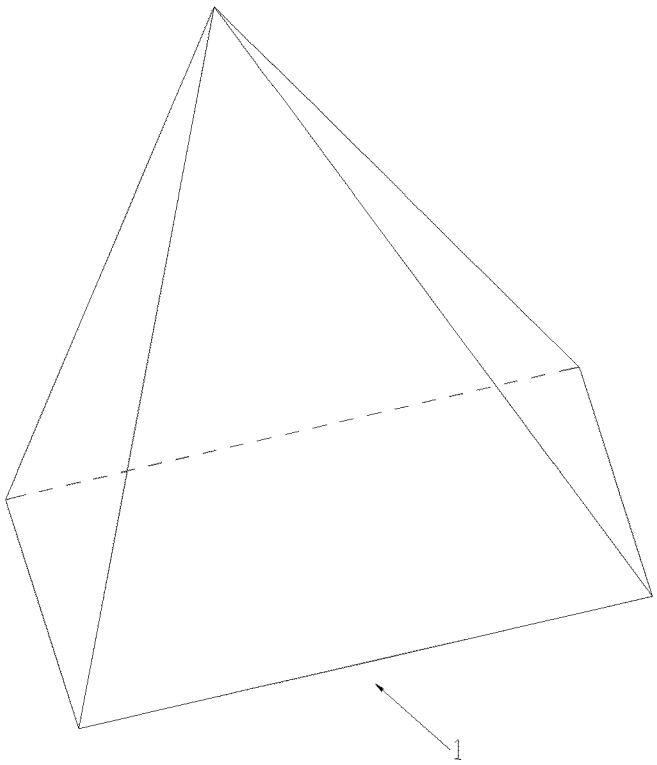
FIG. 12 is a schematic structural diagram when a building block main body is a rectangular pyramid shape according to the present disclosure.
Figure 13:
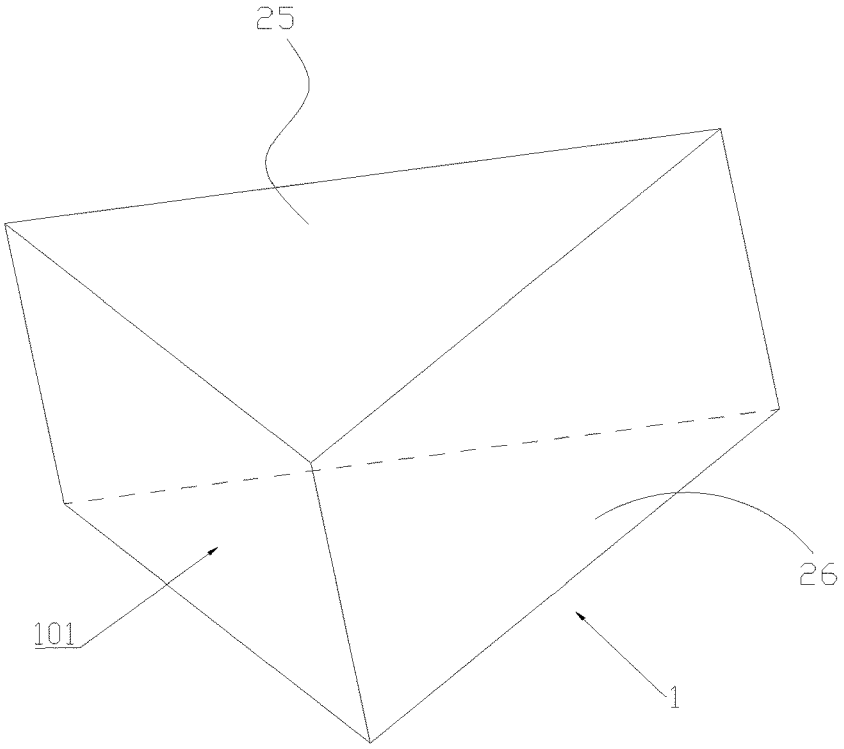
FIG. 13 is a schematic structural diagram when a building block main body is a triangular prism shape according to the present disclosure.
Figure 14:
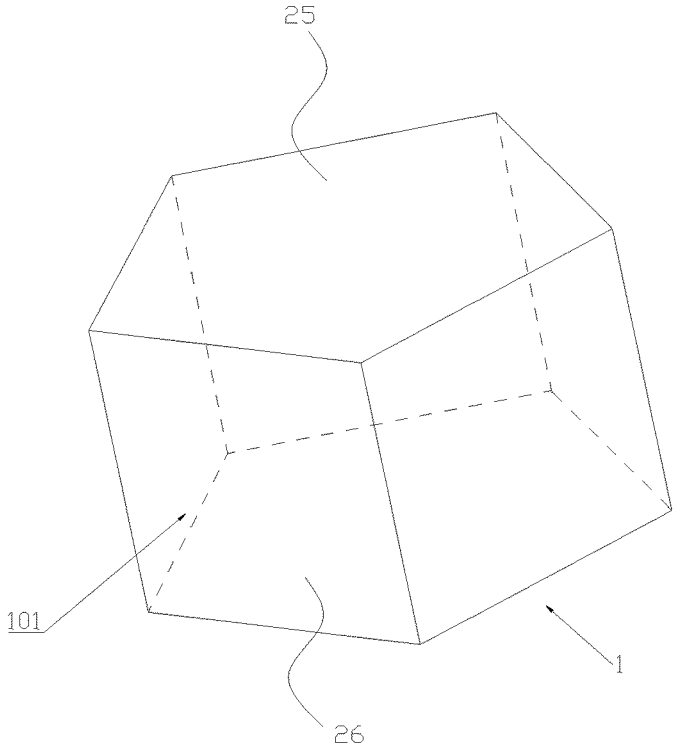
FIG. 14 is a schematic structural diagram when a building block main body is a pentagonal pyramid shape according to the present disclosure.
Figure 15:
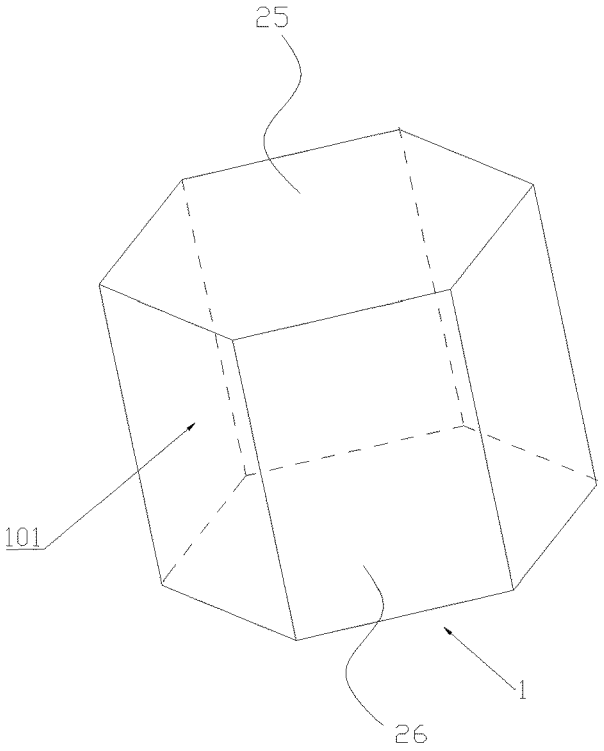
FIG. 15 is a schematic structural diagram when a building block main body is a hexagonal pyramid shape according to the present disclosure.

Referring to FIG. 1 to FIG. 2 and FIG. 10, a magnetic building block includes:

a building block main body 1, wherein the building block main body 1 is formed by several side walls 2 connected to each other; crossed corners 3 are formed at joints between adjacent side walls 2; first compartments 4 are arranged at the crossed corners 3; the several side walls 2 include a first surrounding wall group 101, an upper side wall 25, and a lower side wall 26 that are formed through successive connection; an upper side of the first surrounding wall group 101 is connected to the upper side wall 25, and a lower side of the first surrounding wall group 101 is connected to the lower side wall 26; the crossed corners 3 are formed at joints between the first surrounding wall group 101 and the upper side wall and between the first surrounding wall group 101 and the lower side wall; each crossed corner 3 includes a first crossed corner part and a second crossed corner part; each first compartment 4 includes a first compartment part and a second compartment part; the first compartment part is arranged at the first crossed corner part formed at the joint between the upper side of the first surrounding wall group and the upper side wall, and the second compartment part is arranged at the second crossed corner part formed at the joint between the lower side of the first surrounding wall group and the lower side wall;

a first inner wall group 102, wherein the first inner wall group 102 is connected to an inner surface of the first surrounding wall group 101; the first inner wall group 102 and the inner surface of the first surrounding wall group 101 are encircled to form a mounting slot group 103, and the mounting slot group 103 is arranged between the first compartment part and the second compartment part;

a second inner wall group 104, wherein the second inner wall group 104 is connected to an inner surface of the upper side wall 25; the second inner wall group 104 and the inner surface of the upper side wall 25 form the first compartment part; the first compartment part is communicated to the mounting slot group 103;

a third inner wall group 105, wherein the third inner wall group 105 is connected to an inner surface of the lower side wall 26; the third inner wall group 105 and the inner surface of the lower side wall 26 form the second compartment part; the second compartment part is communicated to the mounting slot group 103;

first magnets 5, wherein each first magnet includes a first magnet part and a second magnet part; the first magnet part is arranged in the first compartment part of the first compartment 4 and can rotate in the first compartment part of the first compartment 4; the first magnet part is provided with an N pole and an S pole; the second magnet part is arranged in the second compartment part of the first compartment 4 and can rotate in the second compartment part of the first compartment 4; the first magnet part and the second magnet part are provided with an N pole and an S pole; and a stop pillar assembly 10, wherein the stop pillar assembly is arranged in the mounting slot group 103; the stop pillar assembly 10 includes several stop pillars; upper sides of the several stop pillars are configured to stop the first magnet part in the first compartment part; and lower sides of the several stop pillars are configured to stop the second magnet part in the second compartment part.

Through the above structure, the magnetic building blocks may attract each other through the first magnets arranged in the first compartments at the crossed corners, so that the magnetic building blocks may be mutually connected at the crossed corners, thereby achieving the misplaced connection among the magnetic building blocks and achieving the design and building of misplaced shapes. Compared with the magnetic building blocks that can only be stacked on the same axis in the existing technology, the present disclosure has the advantages that the building mode and playing method of the magnetic building block provided by the present disclosure are greatly enriched, so as to help children build more shapes, and various pattern combinations may be built in combination with surface patterns of the magnetic building blocks, so as to greatly improve children's interest in modeling and help develop children's imagination. Further, since the first magnet may rotate in the first compartment and is provided with the N pole and the S pole, when the magnetic building blocks are mutually stacked at the crossed corners, the first magnet of the magnetic building block may easily guide the N pole of the magnetic building block to be tightly absorbed with the S pole of another same magnetic building block by the rotation, or guide the S pole of the magnetic building block to be tightly absorbed with the N pole of another same magnetic building block by the rotation, so as to achieve a stable connection among the magnetic building blocks, achieve the misplaced connection among the magnetic building blocks, and achieve the design and building of the misplaced shapes. Referring to FIG. 11 to FIG. 15, the building block main body may be in a shape of a triangular prism or rectangular pyramid, or may be in a shape of a triangular prism, rectangular pyramid, pentagonal prism or hexagonal prism or another shape. It should be noted that FIG. 11 to FIG. 15 only illustrate several different shapes of the building block, and do not illustrate other structures.

In this embodiment, the building block main body 1 is a square building block main body; the square building block main body 1 is provided with six side walls 2, which include a front side wall 21, a rear side wall 22, a left side wall 23, a right side wall 24, an upper side wall 25, and a lower side wall 26; and the front side wall 21, the rear side wall 22, the left side wall 23, and the right side wall 24 are connected in sequence to form the first surrounding wall group 101. A right side of the front side wall 21 is connected to the right side wall 24; upper sides of the front side wall 21 and the right side wall 24 are both connected to the upper side wall 25; lower sides of the front side wall 21 and the right side wall 24 are both connected to the lower side wall 26; a left side of the front side wall 21 is connected to the left side wall 23; upper sides of the front side wall 21 and the left side wall 23 are both connected to the upper side wall 25; lower sides of the front side wall 21 and the left side wall 23 are both connected to the lower side wall 26; a left side of the rear side wall 22 is connected to the right side wall 24; upper sides of the rear side wall 22 and the right side wall 24 are both connected to the upper side wall 25; lower sides of the rear side wall 22 and the right side wall 24 are both connected to the lower side wall 26; a right side of the rear side wall 22 is connected to the left side wall 23; upper sides of the rear side wall 22 and the left side wall 23 are both connected to the upper side wall 25; and lower sides of the rear side wall 22 and the left side wall 23 are both connected to the lower side wall 26. The first crossed corner part includes a first crossed corner unit 31 arranged at a joint among the front side wall 21, the right side wall 24, and the upper side wall 25, a third crossed corner unit 33 arranged at a joint among the front side wall 21, the left side wall 23, and the upper side wall 25, a fifth crossed corner unit 35 arranged at a joint among the rear side wall 22, the right side wall 24, and the upper side wall 25, and a seventh crossed corner unit 37 arranged at a joint among the rear side wall 22, the left side wall 23, and the upper side wall 25. The second crossed corner part includes a second crossed corner unit 32 arranged at a joint among the front side wall 21, the right side wall 24, and the lower side wall 26, a fourth crossed corner unit 34 arranged at a joint among the front side wall 21, the left side wall 23, and the lower side wall 26, a sixth crossed corner unit 36 arranged at a joint among the rear side wall 22, the right side wall 24, and the lower side wall 26, and an eighth crossed corner unit 38 arranged at a joint among the rear side wall 22, the left side wall 23, and the lower side wall 26. Specifically, the first compartment part includes a first compartment unit 41 arranged at the first crossed corner unit 31, a third compartment unit 43 arranged at the third crossed corner unit 33, a fifth compartment unit 45 arranged at the fifth crossed corner unit 35, and a seventh compartment unit 47 arranged at the seventh crossed corner unit 37. The second compartment part includes a second compartment unit 42 arranged at the second crossed corner unit 32, a fourth compartment unit 44 arranged at the fourth crossed corner unit 34, a sixth compartment unit 46 arranged at the sixth crossed corner unit 36, and an eighth compartment unit 48 arranged at the eighth crossed corner unit 38. Further, the first magnet part includes a first magnet unit 51 arranged at the first compartment unit 41, a third magnet unit 53 arranged at the third compartment unit 43, a fifth magnet unit 55 arranged at the fifth compartment unit 45, and a seventh magnet unit 57 arranged at the seventh compartment unit 47. The second magnet part includes a second magnet unit 52 arranged at the second compartment unit 42, a fourth magnet unit 54 arranged at the fourth compartment unit 44, a sixth magnet unit 56 arranged at the sixth compartment unit 46, and an eighth magnet unit 58 arranged at the eighth compartment unit 48. Further, the mounting slot group includes a first mounting slot arranged between the first compartment unit and the second compartment unit, a second mounting slot arranged between the third compartment and the fourth compartment, a third mounting slot arranged between the fifth compartment and the sixth compartment, and a fourth mounting slot arranged between the seventh compartment and the eighth compartment; the stop assembly 10 includes a first stop pillar 711, a second stop pillar 712, a third stop pillar 713, and a fourth stop pillar 714; the first stop pillar is arranged in the first mounting slot; the second stop pillar is arranged in the second mounting slot; the third stop pillar is arranged in the third mounting slot; and the fourth stop pillar is arranged in the fourth mounting slot. An upper side of the first stop pillar 711 stops the first magnet unit 51 inside the first compartment unit 41, and a lower side of the first stop pillar 711 stops the second magnet unit 52 inside the second compartment unit 42. An upper side of the second stop pillar 712 stops the third magnet unit 53 inside the third compartment unit 43, and a lower side of the second stop pillar 712 stops the fourth magnet unit 54 inside the fourth compartment unit 44. An upper side of the third stop pillar 713 stops the fifth magnet unit 55 inside the fifth compartment unit 45, and a lower side of the third stop pillar 713 stops the sixth magnet unit 56 inside the sixth compartment unit 46. An upper side of the fourth stop pillar 714 stops the seventh magnet unit 57 inside the seventh compartment unit 47, and a lower side of the fourth stop pillar 714 stops the eighth magnet unit 58 inside the eighth compartment unit 48. Through the above structure, the magnetic building block has a reasonable design, a simple structure, and a stable connection. By the arrangement of the first magnet at the first corner unit, the second corner unit, the third corner unit, the fourth corner unit, the fifth corner unit, the sixth corner unit, the seventh corner unit, and the eighth corner unit of the square building block, the various magnetic building blocks can be connected and stacked in a misplaced manner at the corners of the side walls, so as to achieve the design and building of the misplaced shapes.

In this embodiment, the first stop pillar 711, the second stop pillar 712, the third stop pillar 713, and the fourth stop pillar 714 are separated from each other to form the first stop pillar 711, the second stop pillar 712, the third stop pillar 713, and the fourth stop pillar 714 with independently individual forms. Through the above structure, the first stop pillar 711, the second stop pillar 712, the third stop pillar 713, and the fourth stop pillar 714 which are separated from each other and have independent forms can facilitate the mounting of the magnetic building blocks and have a low requirement for the assembling accuracy. This can effectively improve the production efficiency and yield. Moreover, due to the first stop pillar 711, the second stop pillar 712, the third stop pillar 713, and the fourth stop pillar 714 which have the independently individual forms, connection structures among all the stop pillars are eliminated, the weight of the product is further reduced, and the magnetism of the magnetic building block is increased. The building block main body is made of a light-transmittance material. Due to the fact that the building block main body is made of the light-transmittance material, the first stop pillar 711, the second stop pillar 712, the third stop pillar 713, and the fourth stop pillar 714 which have the independently individual forms have a more beautiful appearance compared to a first stop pillar, a second stop pillar, a third stop pillar, and a fourth stop pillar which are connected by a connecting shaft, so that the overall shape built through the building block main body is more beautiful.

Figure 3:
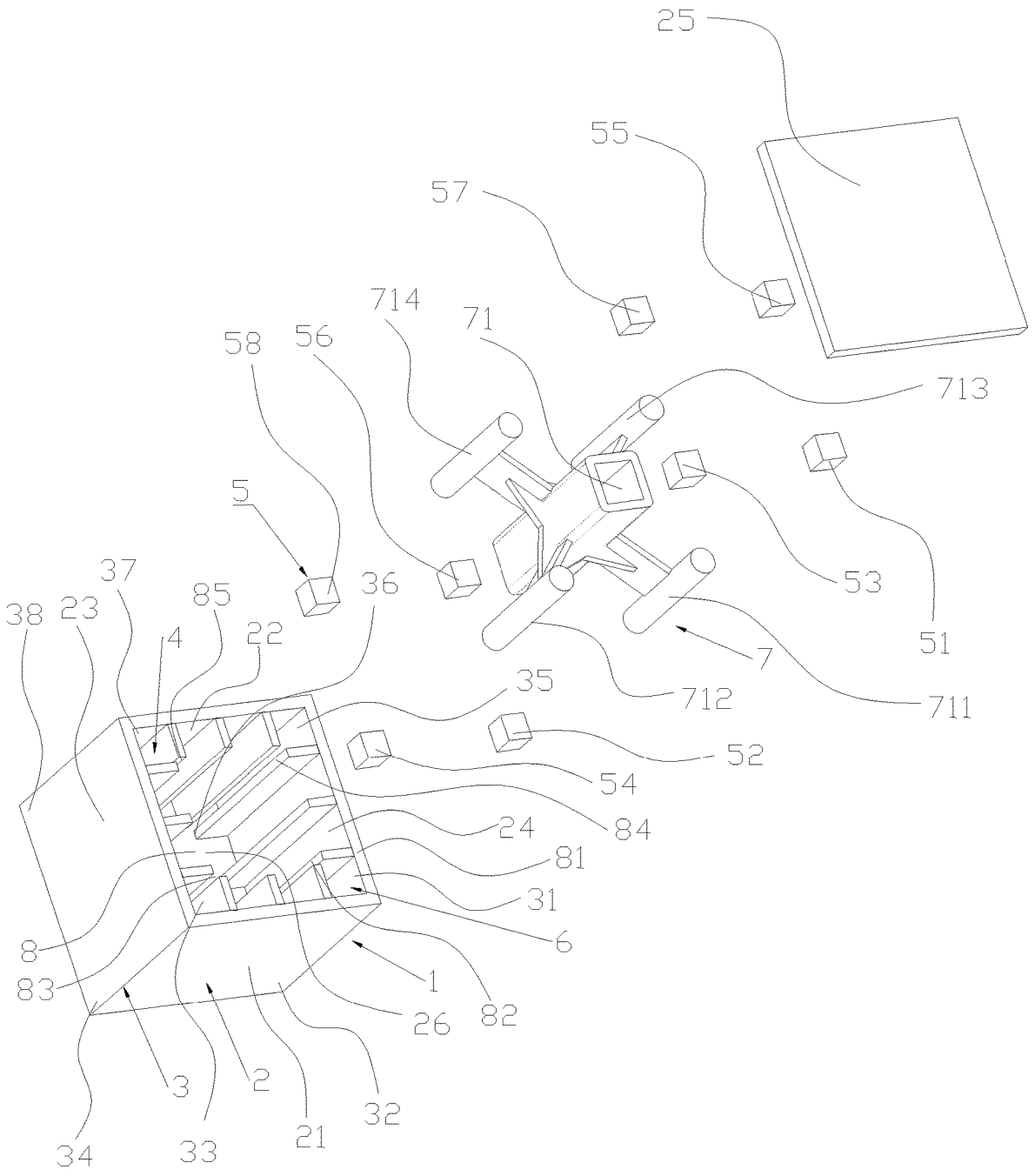
FIG. 3 is an exploded view of Embodiment II of the present disclosure.
Figure 4:
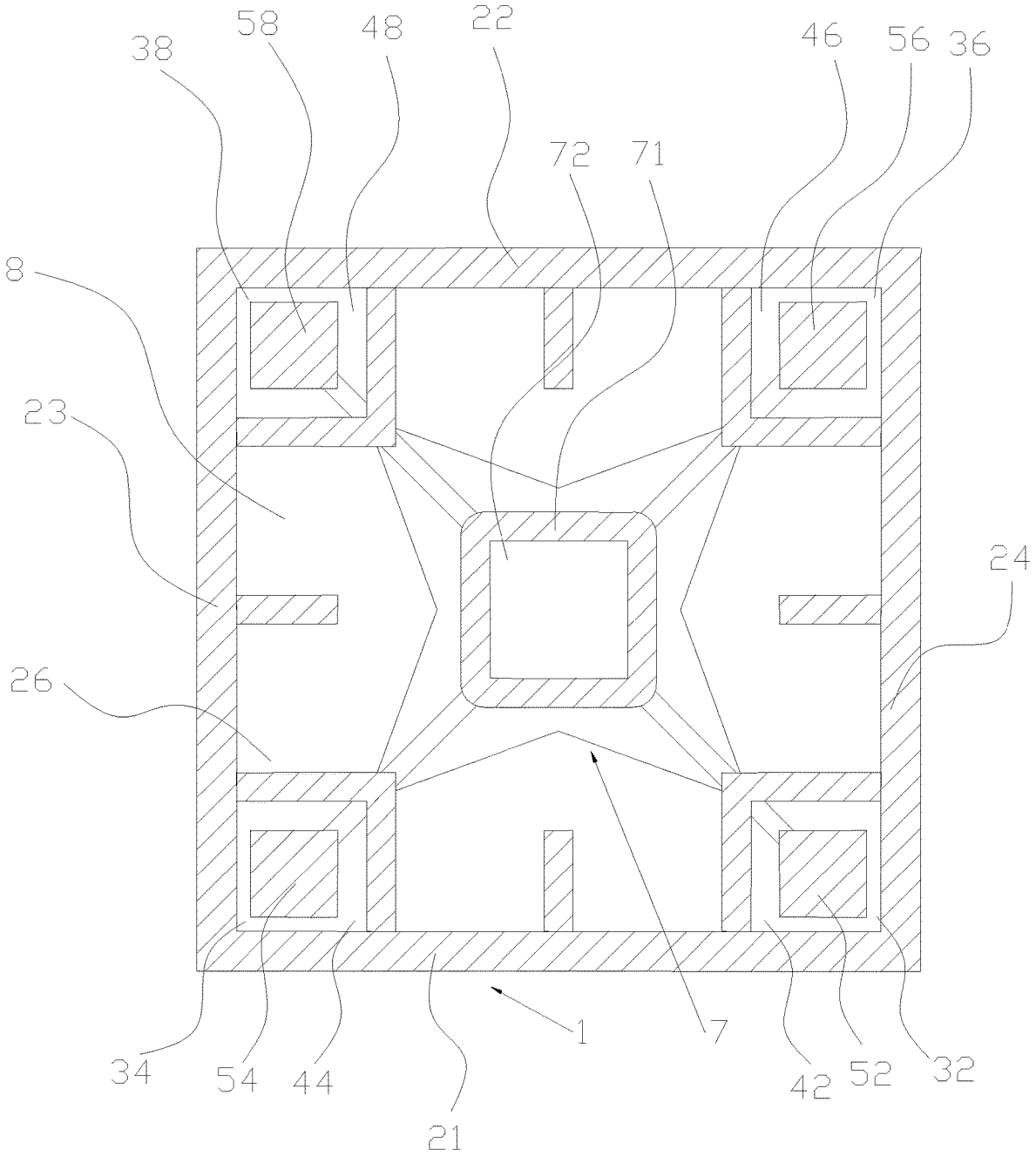
FIG. 4 is a section view cutting along a second corner unit, a fourth corner unit, a sixth corner unit, and an eighth corner unit in Embodiment IV.
Figure 5:
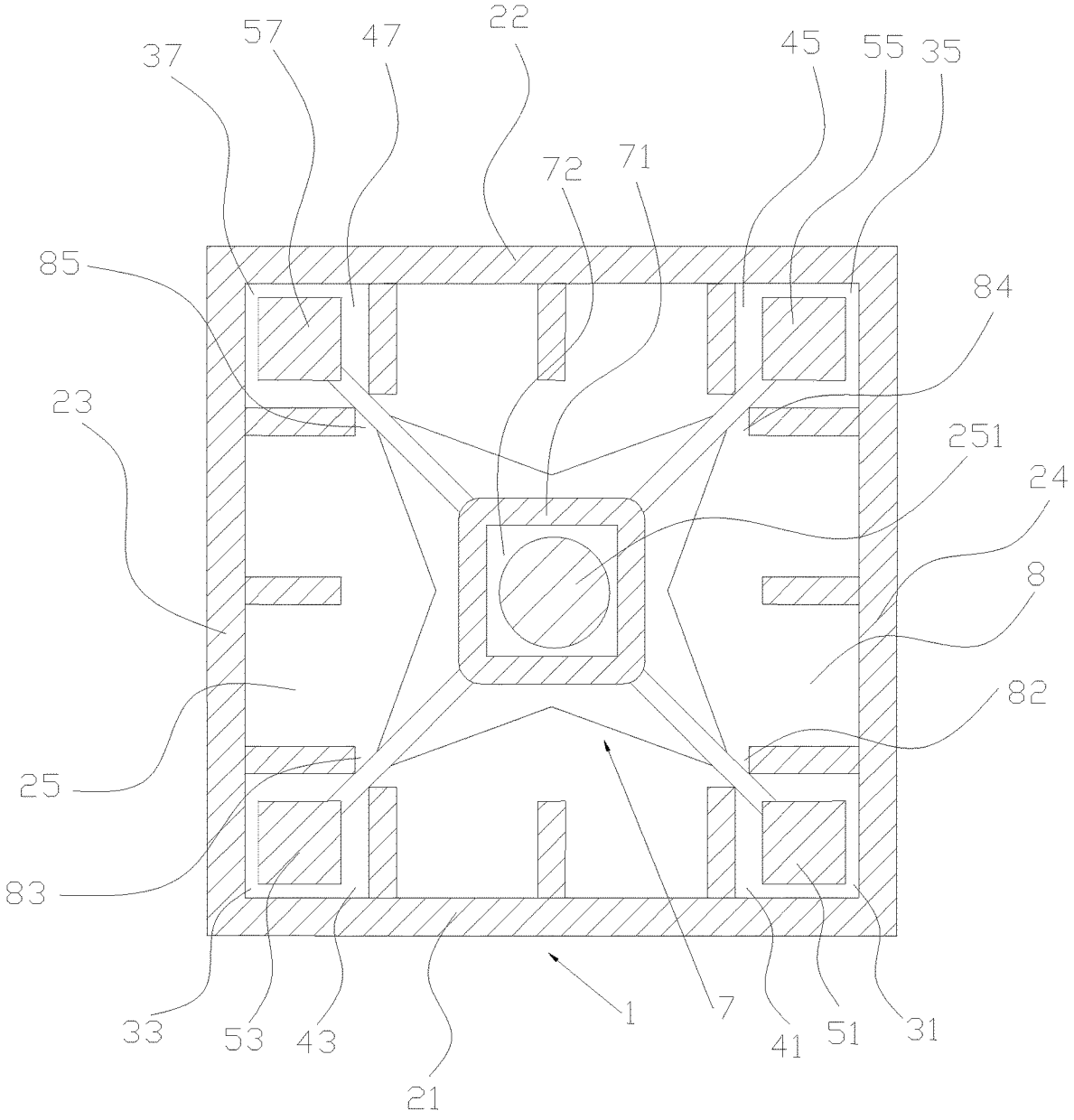
FIG. 5 is a section view cutting along a first corner unit, a third corner unit, a fifth corner unit, and a seventh corner unit in Embodiment III.
Figure 6:
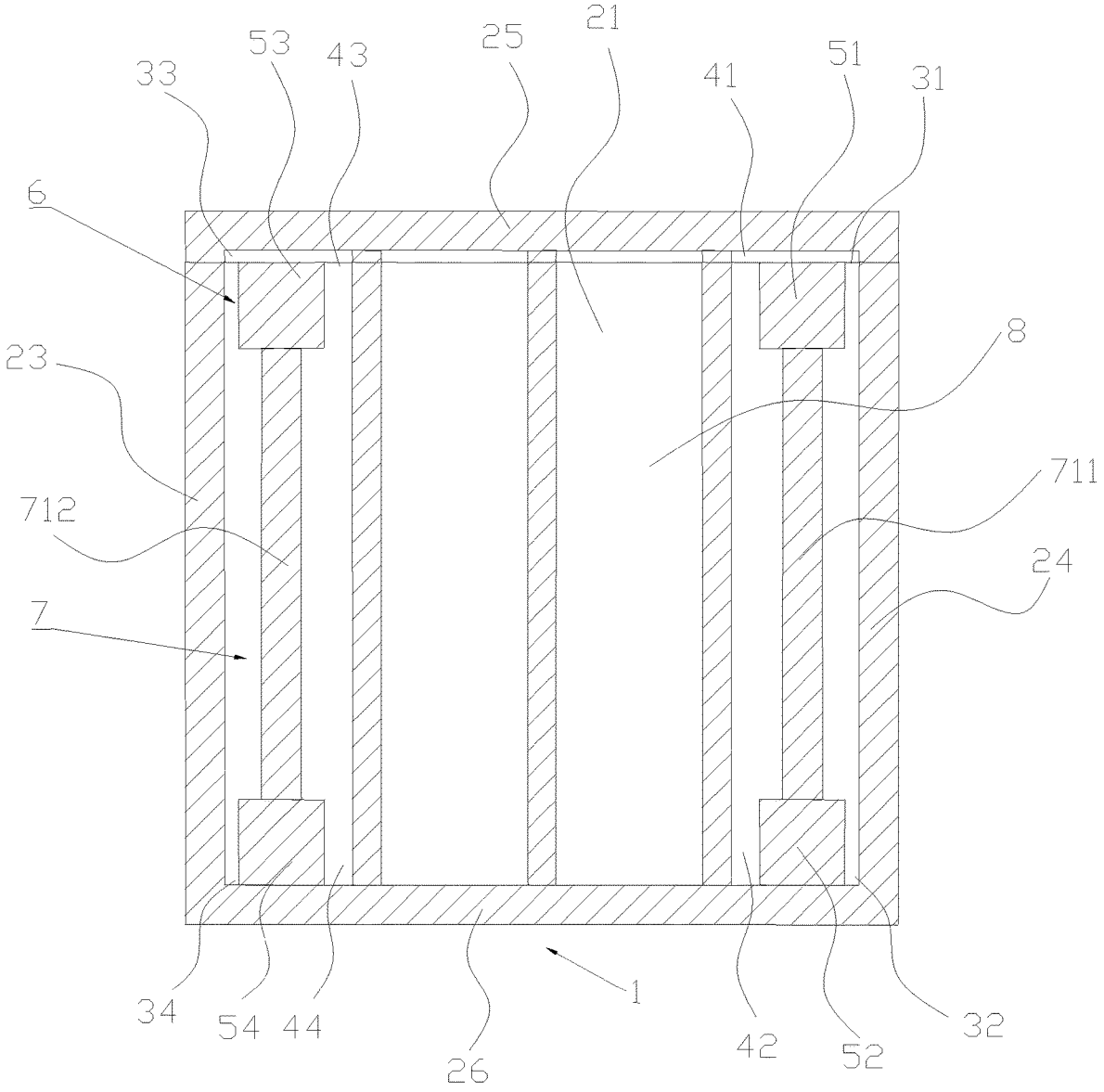
FIG. 6 is a section view cutting along a first corner unit, a second corner unit, a third corner unit, and a fourth corner unit in Embodiment III.
Figure 7:
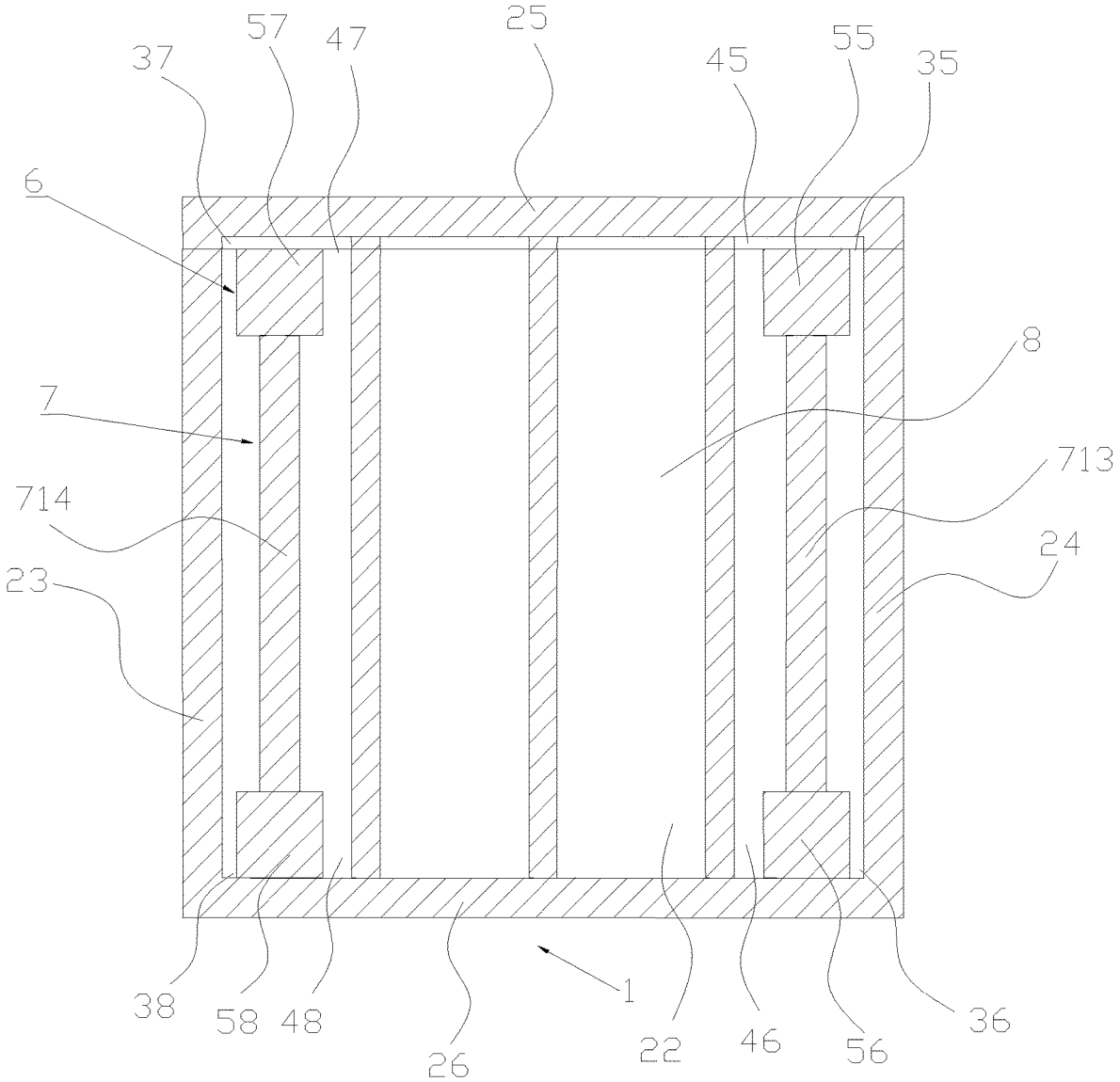
FIG. 7 is a section view cutting along a fifth corner unit, a sixth corner unit, a seventh corner unit, and an eighth corner unit in Embodiment III.
Figure 8:
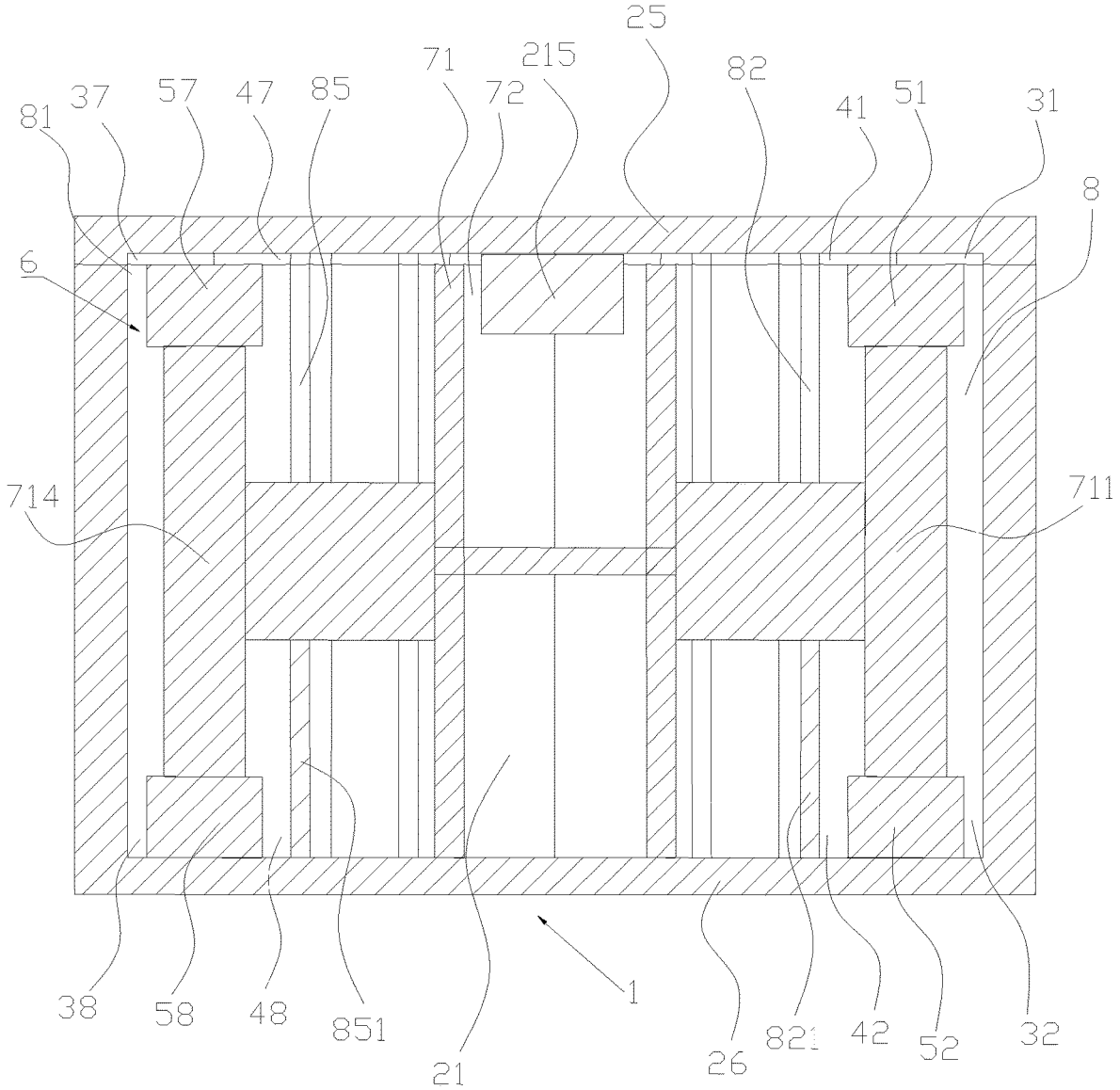
FIG. 8 is a section view cutting along a first corner unit, a second corner unit, a seventh corner unit, and an eighth corner unit in Embodiment III.
Figure 9:
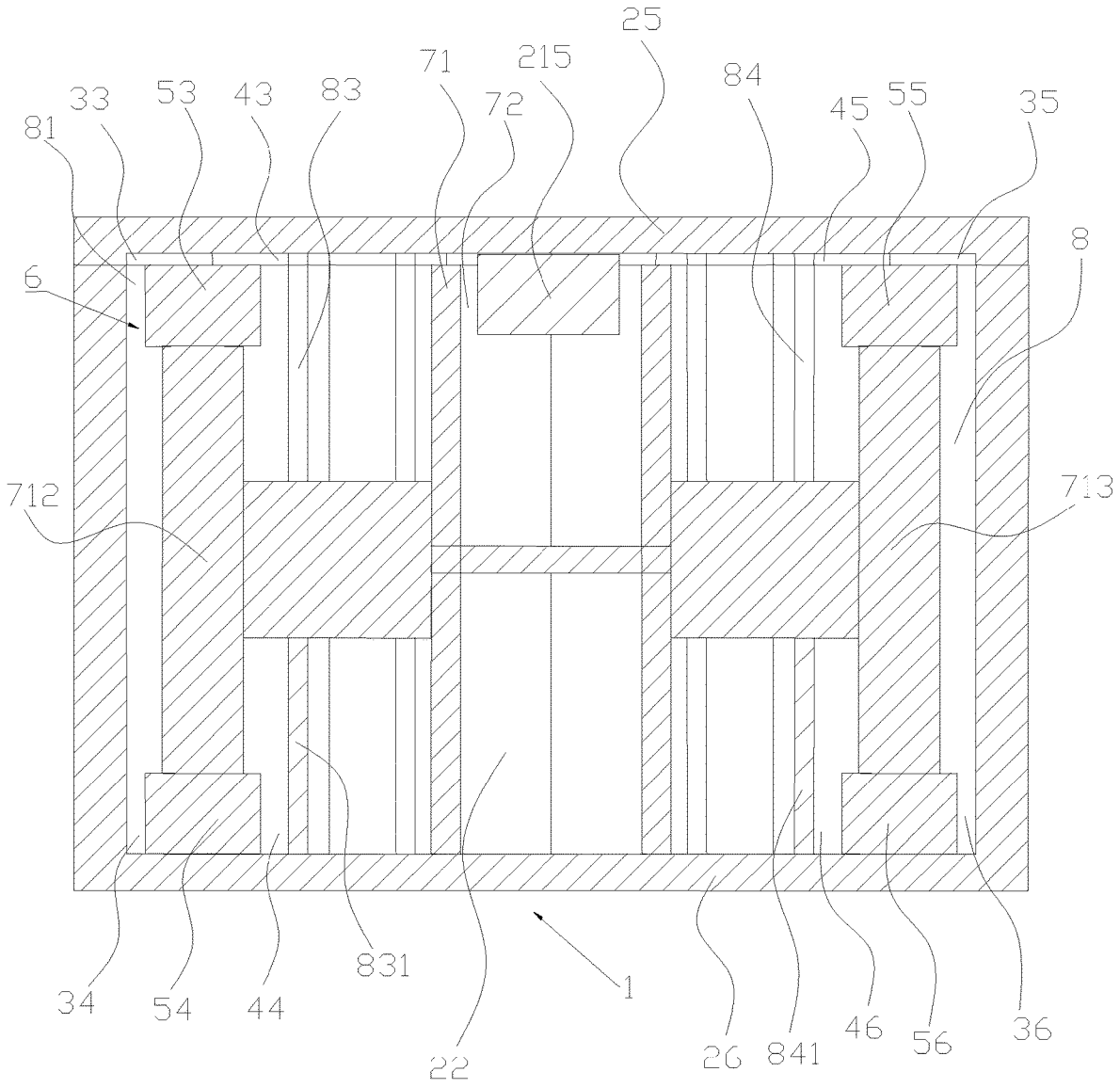
FIG. 9 is a section view cutting along a third corner unit, a fourth corner unit, a fifth corner unit, and a sixth corner unit in Embodiment III.

Referring to FIG. 3, the magnetic building block further includes a connecting shaft, a first stop pillar, a second stop pillar, a third stop pillar, and a fourth stop pillar. The first stop pillar, the second stop pillar, the third stop pillar, and the fourth stop pillar are all connected to the connecting shaft, and the first stop pillar, the second stop pillar, the third stop pillar, and the fourth stop pillar are uniformly arranged around the connecting shaft in a circumferential direction.

Figure 16:
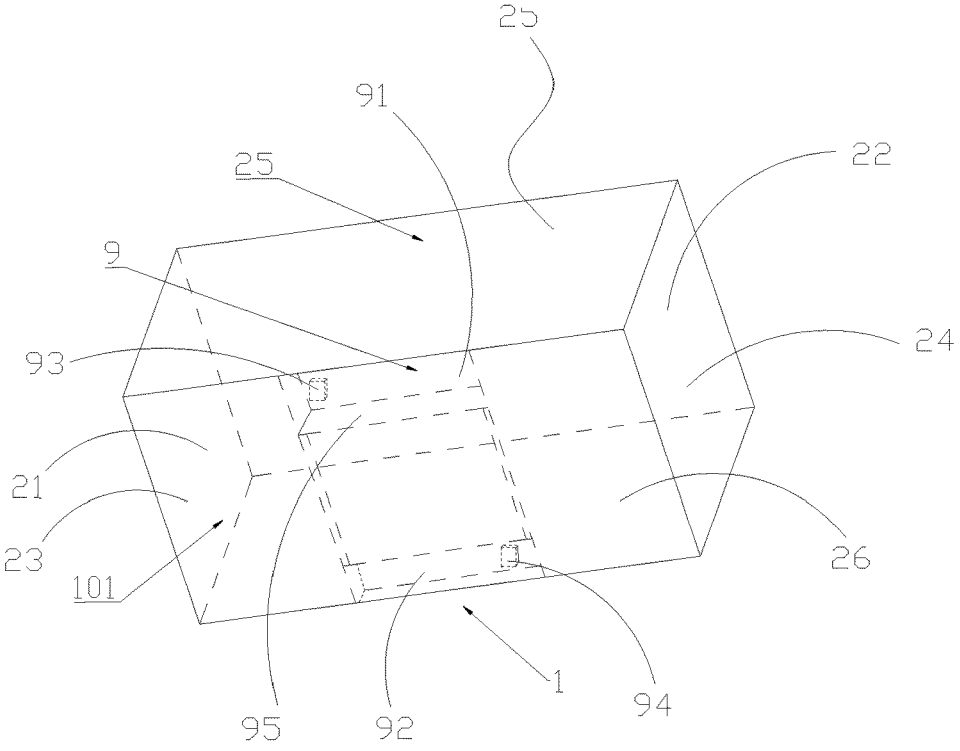
FIG. 16 is a schematic structural diagram of a second compartment, a second magnet, and a second mounting bracket according to the present disclosure.
Figure 17:
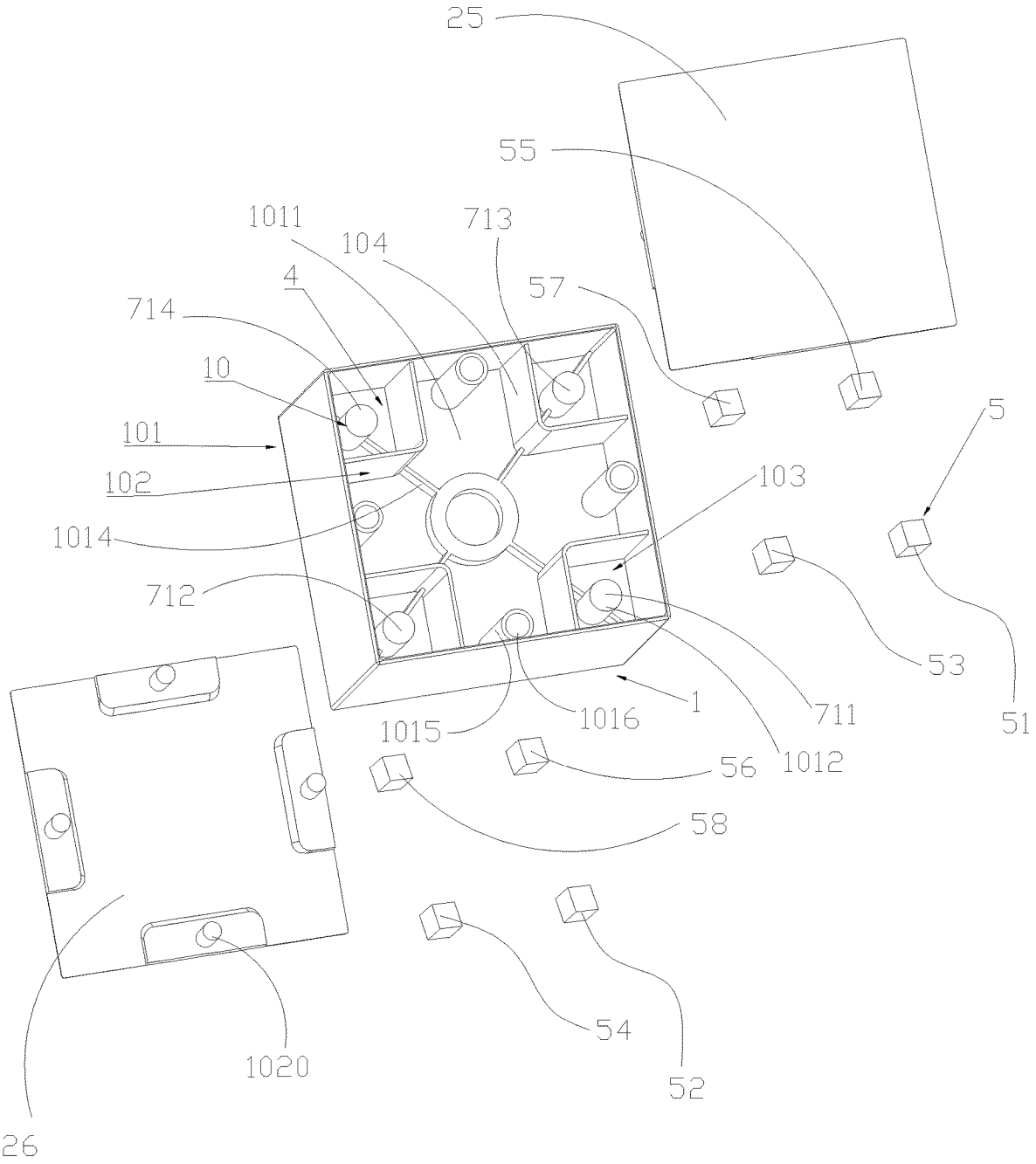
FIG. 17 is a schematic structural diagram of a partition plate part and an upper stop part according to the present disclosure.
Figure 18:
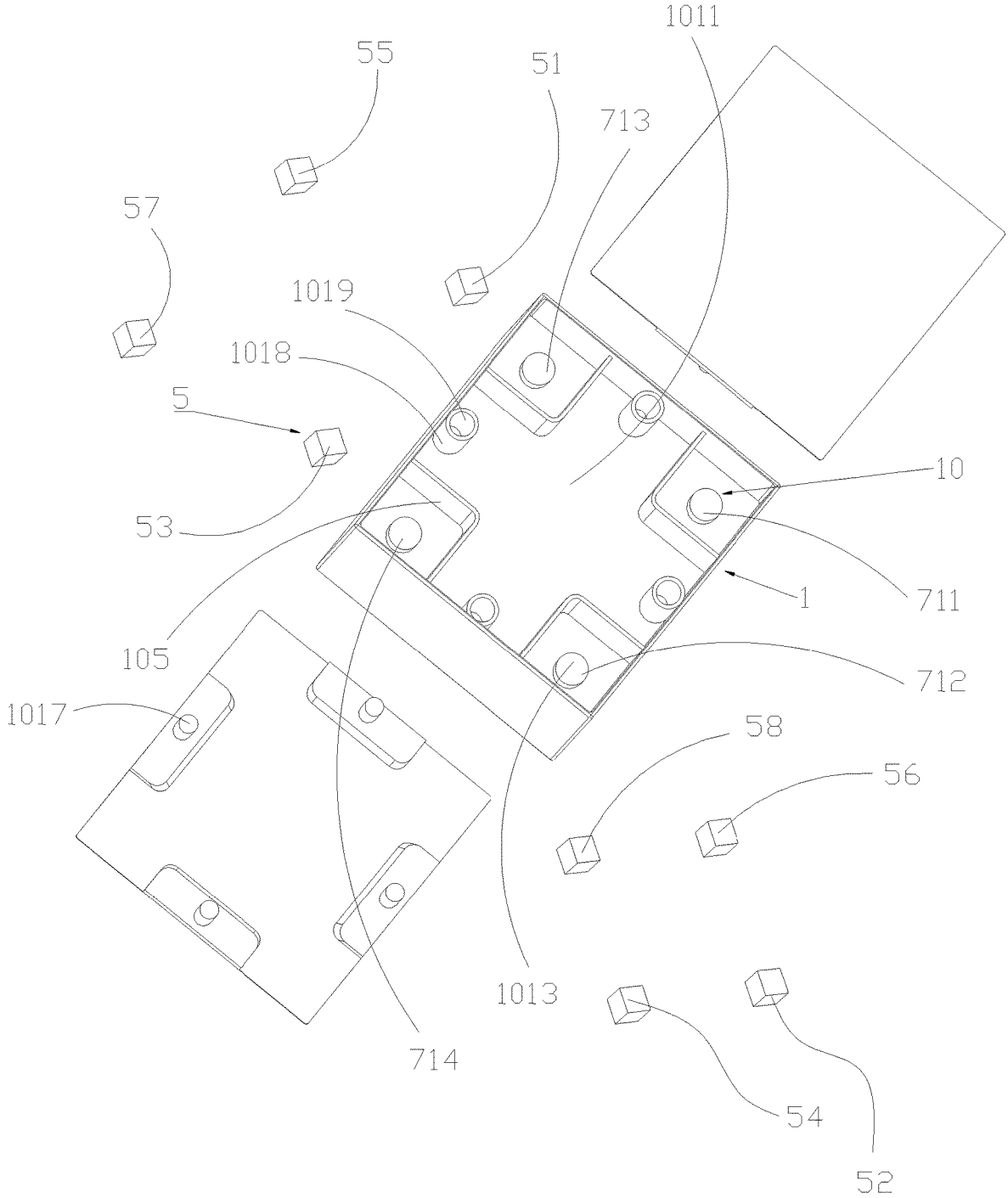
FIG. 18 is a schematic structural diagram of a partition plate part and a lower stop part according to the present disclosure.
Figure 19:
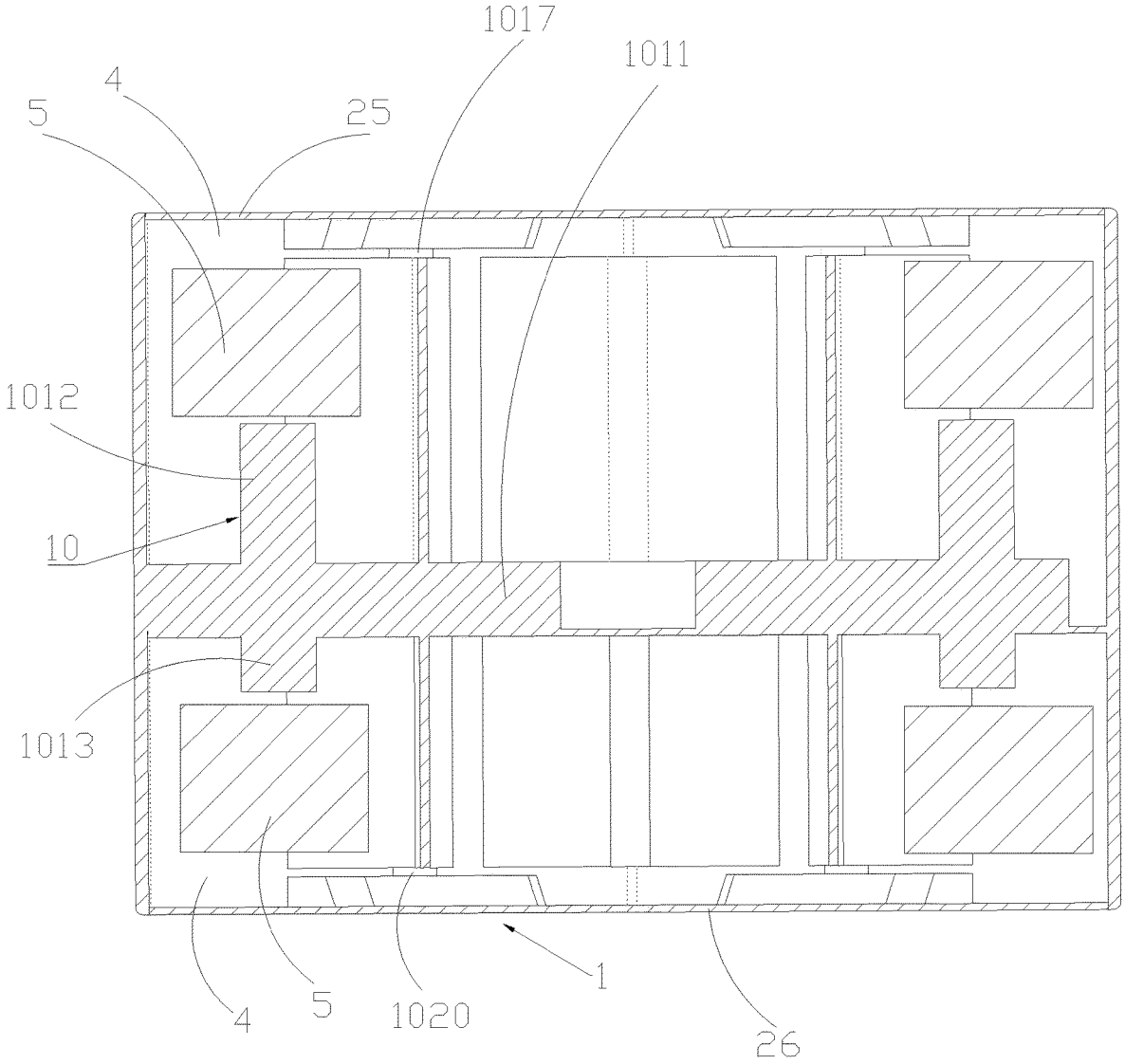
FIG. 19 is a section view cutting along a partition plate part, an upper stop part, and a lower stop part.
Figure 20:
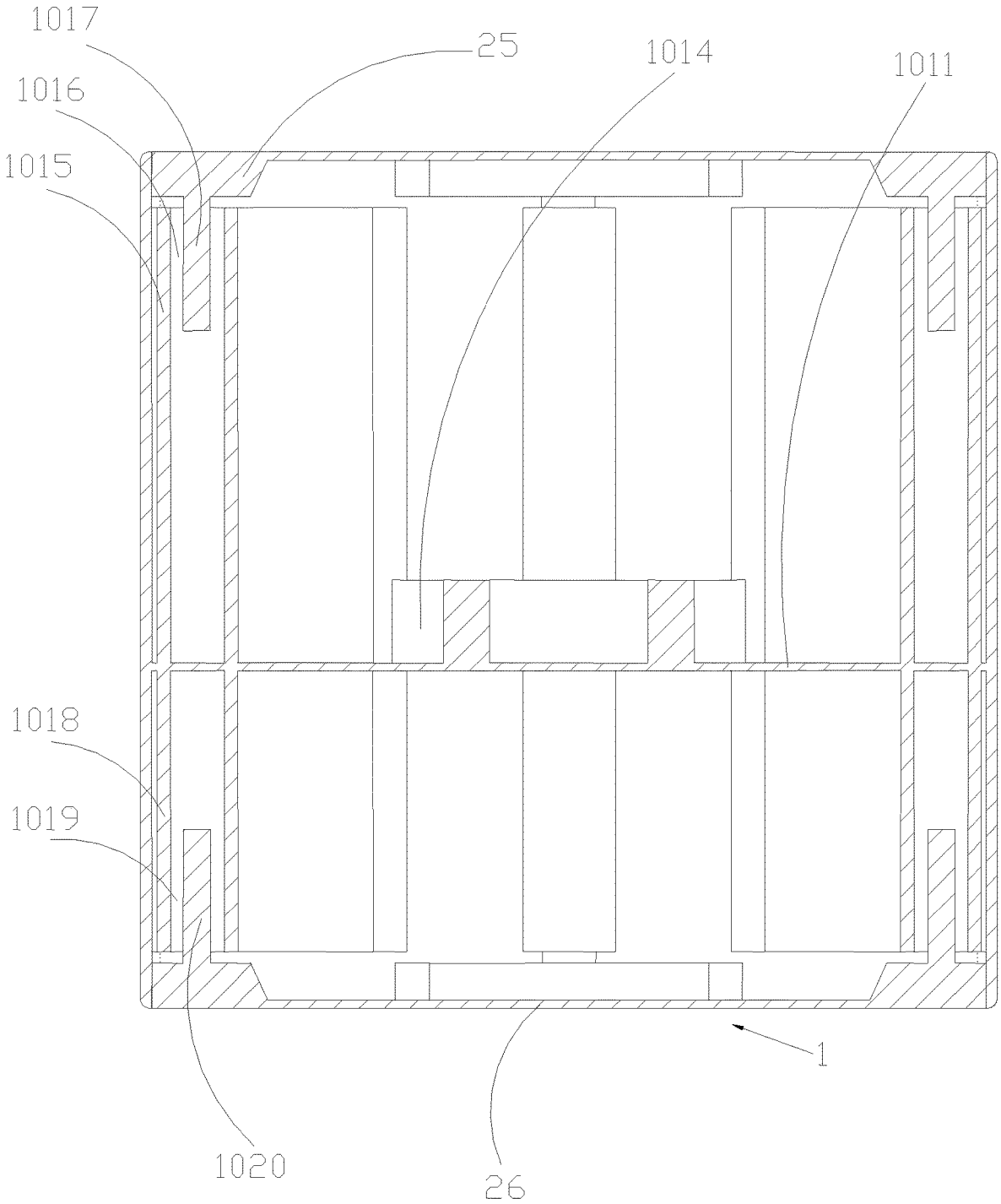
FIG. 20 is a section view cutting along a first positioning pillar, a second positioning pillar, a third positioning pillar, and a fourth positioning pillar.

Referring to FIG. 16, an inner wall of the building block main body 1 is further provided with a second compartment 9; the second compartment 9 is provided with a second magnet; and the second magnet may slide in the second compartment 9. The magnetic building block further includes a second mounting bracket 95; the second mounting bracket 95 is arranged in the second compartment 9, so as to at least divide the second compartment 9 into a ninth compartment unit 91 and a tenth compartment unit 92; the second magnet includes a ninth magnet unit 93 and a tenth magnet unit 94; the ninth magnet unit 93 is arranged in the ninth compartment unit 91 and may slide in the ninth compartment unit 91; and the tenth magnet unit 94 is arranged in the tenth compartment unit 92 and may slide in the tenth compartment unit 92. Specifically, a length of the ninth compartment unit 91 is greater than that of the ninth magnet unit 93; a width of the ninth compartment unit 91 is greater than that of the ninth magnet unit 93; and a height of the ninth compartment unit 91 is greater than that of the ninth magnet unit 93. A length of the tenth compartment unit 92 is greater than that of the tenth magnet unit 94; a width of the tenth compartment unit 92 is greater than that of the tenth magnet unit 94; and a height of the tenth compartment unit 92 is greater than that of the ninth magnet unit 94. Further, the length of the ninth compartment unit 91 is at least twice of that of the ninth magnet unit 93, and the length of the tenth compartment unit 92 is at least twice of that of the tenth magnet unit 94. Through the above structure, the ninth magnet unit slides in the ninth compartment unit, and the tenth magnet unit slides in the tenth compartment unit, so that the ninth magnet unit and the tenth magnet unit can slide to more positions, and it is convenient for a user to achieve the design and building of more misplaced shapes. Furthermore, the hollow second mounting bracket further reduces the weight of the product. The ninth magnet unit slides in the ninth compartment unit, and the tenth magnet unit slides in the tenth compartment unit, so that the magnetism of the magnetic building block is increased. It should be noted that FIG. 16 only illustrates the structure of the second compartment and does not show any other structures.

In this embodiment, the second compartment 9 is arranged on an inner wall of the first surrounding wall group, and the second compartment 9 extends from a lower side of the first surrounding wall group to an upper side of the first surrounding wall group. The second mounting bracket 95 is arranged at a middle part of the second compartment 9, so that the second mounting bracket 95 separates the second compartment 9 into the ninth compartment unit 91 arranged on the upper side of the first surrounding wall group and the tenth compartment unit 92 arranged on the lower side of the first surrounding wall group. The second compartment 9 is arranged on the upper side wall, and the second compartment 9 extends from a lower side of the upper side wall to an upper side of the upper side wall. The second mounting bracket 95 is arranged at the middle part of the second compartment 9, so that the second mounting bracket 95 separates the second compartment 9 into the ninth compartment unit 91 arranged on the upper side of the upper side wall and the tenth compartment unit 92 arranged on the lower side of the upper side wall. Specifically, the second compartment 9 is arranged on lower side wall, and the second compartment 9 extends from a lower side of the lower side wall to an upper side of the lower side wall. The second mounting bracket 95 is arranged at a middle part of the second compartment 9, so that the mounting bracket separates the second compartment 9 into the ninth compartment unit 91 arranged on the upper side of the lower side wall and the tenth compartment unit 92 arranged on the lower side of the lower side wall. Further, the second compartment 9 is square, and the second mounting bracket 95 is a hollow and square. Through the above structure, the arrangement of the second compartment is effectively achieved, making it easier for the user to design and build more misplaced shapes.

Embodiment II

Referring to FIG. 1 to FIG. 2 and FIG. 10, a building block main body 1 is provided. The building block main body 1 includes a first surrounding wall group, an upper side wall 25, a lower side wall 26, a first inner wall group 102, a third inner wall group 105, and a second inner wall group 104; a lower side of the first surrounding wall group 101 is connected to the lower side wall 261, and a second crossed corner part is formed at a joint between the lower side of the first surrounding wall group 101 and the lower side wall 26; the third inner wall group 105 is connected to an inner surface of the lower side wall 26, and the third inner wall group 105 and the inner surface of the lower side wall 26 form a second compartment part; the first inner wall group 102 is connected to the inner surface of the first surrounding wall group 101; the first inner wall group 102 and the inner surface of the first surrounding wall group 101 are encircled to form a mounting slot group 103; and the mounting slot group 103 is communicated to the second compartment part.

First magnets 5 are provided. Each first magnet includes a first magnet part and a second magnet part; the second magnet part is arranged in the second compartment part and may rotate in the second compartment part; and the first magnet part and the second magnet part are respectively provided with an N pole and an S pole.

A stop pillar assembly 10 is provided. The stop pillar assembly 10 includes several stop pillars; the several stop pillars are arranged in the mounting slot group 103, so that lower sides of the several stop pillars stop the second magnet parts in the second compartment part;

the first magnet part is arranged at upper sides of the stop pillars; the upper side wall 25 is connected to the upper side of the first surrounding wall group 101 in an ultrasonic hot melting manner;

the second inner wall group 104 is connected to an inner surface of the upper side wall 25; the second inner wall group 104 and the inner surface of the upper side wall 25 form the first compartment part; the first compartment part is communicated with the mounting slot group 103, so that the upper sides of the several stop pillars stop the first magnet part in the first compartment part; and the first magnet part may rotate in the first compartment part. The upper side wall is connected to the upper side of the first surrounding wall group in an ultrasonic hot melting manner or a gluing manner.

Through the above structure, the upper side wall is connected to the upper side of the first surrounding wall group 101. The magnetic building block has a reasonable design, a simple and reliable structure, and a stable connection, can effectively improve the production efficiency, and has low cost.

Embodiment III

Referring to FIG. 1 and FIG. 3 to FIG. 10, a magnetic building block includes a building block main body 1. The building block main body 1 is formed by several side walls 2 connected to each other; crossed corners 3 are formed at joints between adjacent side walls 2; first compartments 4 are arranged at the crossed corners 3; and first magnets 5 are arranged in the first compartments 4. The first magnets 5 may rotate in the first compartments 4. Each first magnet 5 is provided with an N pole and an S pole. Through the above structure, the magnetic building block includes the building block main body. The building block main body is formed by the several side walls connected to each other; the crossed corners are formed at joints between the adjacent side walls; the first compartments are arranged at the crossed corners; and the first magnets are arranged in the first compartments. The magnetic building blocks may attract each other through the first magnets arranged in the first compartments at the crossed corners, so that the magnetic building blocks may be mutually connected at the crossed corners, thereby achieving the misplaced connection among the magnetic building blocks and achieving the design and building of misplaced shapes. Compared with the magnetic building blocks that can only be stacked on the same axis in the existing technology, the present disclosure has the advantages that the building mode and playing method of the magnetic building block provided by the present disclosure are greatly enriched, so as to help children build more shapes, and various pattern combinations may be built in combination with surface patterns of the magnetic building blocks, so as to greatly improve children's interest in modeling and help develop children's imagination. Further, since the first magnet may rotate in the first compartment and is provided with the N pole and the S pole, when the magnetic building blocks are mutually stacked at the crossed corners, the first magnet of the magnetic building block may easily guide the N pole of the magnetic building block to be tightly absorbed with the S pole of another same magnetic building block by the rotation, or guide the S pole of the magnetic building block to be tightly absorbed with the N pole of another same magnetic building block by the rotation, so as to achieve a stable connection among the magnetic building blocks, achieve the misplaced connection among the magnetic building blocks, and achieve the design and building of the misplaced shapes.

In this embodiment, the building block main body 1 is a square building block main body; the building block main body 1 is provided with six side walls 2, which include a front side wall 21, a rear side wall 22, a left side wall 23, a right side wall 24, an upper side wall 25, and a lower side wall 26; a right side of the front side wall 21 is connected to the right side wall 24; upper sides of the front side wall 21 and the right side wall 24 are both connected to the upper side wall 25; lower sides of the front side wall 21 and the right side wall 24 are both connected to the lower side wall 26; a left side of the front side wall 21 is connected to the left side wall 23; upper sides of the front side wall 21 and the left side wall 23 are both connected to the upper side wall 25; lower sides of the front side wall 21 and the left side wall 23 are both connected to the lower side wall 26; a left side of the rear side wall 22 is connected to the right side wall 24; upper sides of the rear side wall 22 and the right side wall 24 are both connected to the upper side wall 25; lower sides of the rear side wall 22 and the right side wall 24 are both connected to the lower side wall 26; a right side of the rear side wall 22 is connected to the left side wall 23; upper sides of the rear side wall 22 and the left side wall 23 are both connected to the upper side wall 25; and lower sides of the rear side wall 22 and the left side wall 23 are both connected to the lower side wall 26. Each crossed corner 3 includes a first crossed corner unit 31 arranged at a joint among the front side wall 21, the right side wall 24, and the upper side wall 25, a second crossed corner unit 32 arranged at a joint among the front side wall 21, the right side wall 24 and the lower side wall 26, a third crossed corner unit 33 arranged at a joint among the front side wall 21, the left side wall 23, and the upper side wall 25, a fourth crossed corner unit 34 arranged at a joint among the front side wall 21, the left side wall 23, and the lower side wall 26, a fifth crossed corner unit 35 arranged at a joint among the rear side wall 22, the right side wall 24, and the upper side wall 25, a sixth crossed corner unit 36 arranged at a joint among the rear side wall 22, the right side wall 24, and the lower side wall 26, a seventh crossed corner unit 37 arranged at a joint among the rear side wall 22, the left side wall 23, and the upper side wall 25, and an eighth crossed corner unit 38 arranged at a joint among the rear side wall 22, the left side wall 23, and the lower side wall 26. Specifically, each first compartment 4 includes a first compartment unit 41 arranged at the first crossed corner unit 31, a second compartment unit 42 arranged at the second crossed corner unit 32, a third compartment unit 43 arranged at the third crossed corner unit 33, a fourth compartment unit 44 arranged at the fourth crossed corner unit 34, a fifth compartment unit 45 arranged at the fifth crossed corner unit 35, a sixth compartment unit 46 arranged at the sixth crossed corner unit 36, a seventh compartment unit 47 arranged at the seventh crossed corner unit 37, and an eighth compartment unit 48 arranged at the eighth crossed corner unit 38. Further, each first magnet 5 includes a first magnet unit 51 arranged at the first compartment unit 41, a second magnet unit 52 arranged at the second compartment unit 42, a third magnet unit 53 arranged at the third compartment unit 43, a fourth magnet unit 54 arranged at the fourth compartment unit 44, a fifth magnet unit 55 arranged at the fifth compartment unit 45, a sixth magnet unit 56 arranged at the sixth compartment unit 46, a seventh magnet unit 57 arranged at the seventh compartment unit 47, and an eighth magnet unit 58 arranged at the eighth compartment unit 48. Through the above structure, the magnetic building block has a reasonable design, a simple structure, and a stable connection. By the arrangement of the first magnet at the first corner unit, the second corner unit, the third corner unit, the fourth corner unit, the fifth corner unit, the sixth corner unit, the seventh corner unit, and the eighth corner unit of the square building block, the various magnetic building blocks can be connected and stacked in a misplaced manner at the corners of the side walls, so as to achieve the design and building of the misplaced shapes.

In this embodiment, the first compartment 4 is provided with a mounting opening 6, and the first magnet 5 is placed in the first compartment 4 through the mounting opening 6. The magnetic building block further includes a first mounting bracket 7, and an accommodating cavity 8 is formed among the left side wall 23, the right side wall 24, the front side wall 21, the rear side wall 22, and the lower side wall 26. The accommodating cavity 8 is provided with an accommodating opening 81. When the first mounting bracket 7 is placed in the accommodating cavity 8 through the accommodating opening 81, the upper side wall 25 covers the accommodating opening 81, so that the first mounting bracket 7 stops the first magnet 5 in the first compartment 4. The first mounting bracket 7 includes a connecting shaft 71; a positioning shaft hole 72 is formed in the connecting shaft 71; the upper side wall 25 is provided with a positioning shaft 251; and when the upper side wall 25 covers the accommodating opening 81, the positioning shaft 251 is sleeved in the positioning shaft hole 72. Specifically, the connecting shaft 71 is provided with a first stop pillar 711, a second stop pillar 712, a third stop pillar 713, and a fourth stop pillar 714. The first stop pillar 711, the second stop pillar 712, the third stop pillar 713, and the fourth stop pillar 714 are uniformly arranged around the connecting shaft 71 in a circumferential direction. An upper side of the first stop pillar 711 stops the first magnet unit 51 inside the first compartment unit 41, and a lower side of the first stop pillar 711 stops the second magnet unit 52 inside the second compartment unit 42. An upper side of the second stop pillar 712 stops the third magnet unit 53 inside the third compartment unit 43, and a lower side of the second stop pillar 712 stops the fourth magnet unit 54 inside the fourth compartment unit 44. An upper side of the third stop pillar 713 stops the fifth magnet unit 55 inside the fifth compartment unit 45, and a lower side of the third stop pillar 713 stops the sixth magnet unit 56 inside the sixth compartment unit 46. An upper side of the fourth stop pillar 714 stops the seventh magnet unit 57 inside the seventh compartment unit 47, and a lower side of the fourth stop pillar 714 stops the eighth magnet unit 58 inside the eighth compartment unit 48. Through the above structure, a structure in which the first magnets are arranged in the first corner unit, the second corner unit, the third corner unit, the fourth corner unit, the fifth corner unit, the sixth corner unit, the seventh corner unit, and the eighth corner unit is effectively implemented; and the first magnet is stopped in the first compartment through the first mounting bracket, so that the position of the first magnet may be fixed in the first compartment, thereby ensuring the connection stability among the magnetic building blocks.

In this embodiment, a first slot 82, a second slot 83, a third slot 84, and a fourth slot 85 are also arranged in the accommodating cavity 8. A first stop edge 821 is arranged on the first slot 82; the first stop edge 821 is configured to stop the first stop pillar 711, so that a distance between a lower side of the first stop pillar 711 and the lower side wall 26 is fixed, and the second magnet unit 52 can rotate in the second compartment unit 42; a second stop edge 831 is arranged on the second slot 83; the second stop edge 831 is configured to stop the second stop pillar 712, so that a distance between a lower side of the second stop pillar 712 and the lower side wall 26 is fixed, and the fourth magnet unit 54 can rotate in the fourth compartment unit 44; a third stop edge 841 is arranged on the third slot 84; the third stop edge 841 is configured to stop the third stop pillar 713, so that a distance between a lower side of the third stop pillar 713 and the lower side wall 26 is fixed, and the sixth magnet unit 56 can rotate in the sixth compartment unit 46; a fourth stop edge 851 is arranged on the fourth slot 85; the fourth stop edge 851 is configured to stop the fourth stop pillar 714, so that a distance between a lower side of the fourth stop pillar 714 and the lower side wall 26 is fixed, and the eighth magnet unit 58 can rotate in the eighth compartment unit 48. A horizontal width of the first magnet is less than that of the first compartment; a horizontal length of the first magnet is less than that of the first compartment; and a longitudinal height of the first magnet is less than that of the first compartment. Through the above structure, the magnetic building block has a reasonable design, a simple structure, and a stable connection. Through the first stop edge, the second stop edge, the third stop edge, and the fourth stop edge, a mounting position of the first mounting bracket may be fixed, which is not only convenient for a user to mount the first mounting bracket, but also ensures that an accommodating space of the first compartment is not compressed by the first mounting bracket, thereby ensuring that the first magnet may rotate in the first compartment.

Embodiment IV

Referring to FIG. 1 to FIG. 2, FIG. 10, and FIG. 17 to FIG. 20, a magnetic building block includes:

a building block main body 1, including a first surrounding wall group 101 formed by connecting a plurality of surrounding walls end to end in sequence, an upper side wall connected to an upper end of the first surrounding wall group 101, a lower side wall connected to a lower end of the first surrounding wall group 101, at least one supporting wall connected to an inner side of the first surrounding wall group 101, a partition plate part, and a stop assembly, wherein a first compartment part is formed between an upper side of the supporting wall and the inner side of the first surrounding wall group 101, and a second compartment part is formed between a lower side of the supporting wall and the inner side of the first surrounding wall group 101;

a first crossed corner is formed at a joint between an upper end of the first surrounding wall group 101 and the upper side wall, and a second crossed corner is formed at a joint between the lower end of the first surrounding wall group 101 and the lower side wall; the first compartment is arranged at the first crossed corner, and the second compartment is arranged at the second crossed corner;

a first magnet part and a second magnet part, wherein the first magnet part is arranged inside the first compartment part, and the first magnet part is able to rotate in the first compartment part; the first magnet part is provided with an N pole and an S pole; the second magnet part is arranged inside the second compartment part, and the second magnet part is able to rotate in the second compartment part; first magnet part and the second magnet part 5 are both provided with an N pole and an S pole;

the partition plate part 1011 is connected to an inner surface of the first surrounding wall group 101, and the partition plate part 1011 is located between the upper side wall 25 and the lower side wall 26;

the stop assembly includes an upper stop part 1012 and a lower stop part 1013; a lower side of the upper stop part 1012 is connected to an upper surface of the partition plate part 1011; an upper side of the upper stop part 1012 is configured to stop the first magnet part inside the first compartment part; an upper side of the lower stop part 1013 is connected to a lower surface of the partition plate part 1011; and a lower side of the lower stop part 1013 is configured to stop the second magnet part inside the second compartment part.

Through the above structure, the magnetic building blocks may attract each other through the first magnet part arranged at the first compartment part at the first crossed corner and the second magnet part arranged at the second compartment part at the second crossed corner, so that the magnetic building blocks may be mutually connected at the crossed corners, thereby achieving the misplaced connection among the magnetic building blocks and achieving the design and building of misplaced shapes. Compared with the magnetic building blocks that can only be stacked on the same axis in the existing technology, the present disclosure has the advantages that the building mode and playing method of the magnetic building block provided by the present disclosure are greatly enriched, so as to help children build more shapes, and various pattern combinations may be built in combination with surface patterns of the magnetic building blocks, so as to greatly improve children's interest in modeling and help develop children's imagination. Further, since the first magnet part may rotate in the first compartment part and the second magnet part may rotate in the second compartment part, and the first magnet part and the second magnet part are both provided with the N poles and the S poles, when the magnetic building blocks are mutually stacked at the crossed corners, the first magnet part and the second magnet part of the magnetic building block may easily guide the N pole of the magnetic building block to be tightly absorbed with the S pole of another same magnetic building block by the rotation, or guide the S pole of the magnetic building block to be tightly absorbed with the N pole of another same magnetic building block by the rotation, so as to achieve a stable connection among the magnetic building blocks, achieve the misplaced connection among the magnetic building blocks, and achieve the design and building of the misplaced shapes. Referring to FIG. 11 to FIG. 15, the building block main body may be in a shape of a triangular prism or rectangular pyramid, or may be in a shape of a triangular prism, rectangular pyramid, pentagonal prism or hexagonal prism or another shape. It should be noted that FIG. 11 to FIG. 15 only illustrate several different shapes of the building block, and do not illustrate other structures. Furthermore, the stop assembly is separated into the upper stop part and the lower stop part by the partition plate part, so that the strength of the stop assembly can be improved. The upper stop part may stop the first magnet part at the first compartment part, and the lower stop part may stop the second magnet part at the second compartment part.

In this embodiment, the partition plate part 1011, the first surrounding wall group 101, the supporting wall, the upper stop part 1012, and the lower stop part 1013 are integrally formed, so that the building block main body is more convenient to produce, and the production efficiency is improved. Furthermore, the integrality of the building block main body is higher, and the strength of the building block main body is greatly improved.

In this embodiment, a length of the upper stop part 1012 is greater than that of the lower stop part 1013. Several reinforcing ribs 1014 are arranged on the upper surface of the partition plate in a protruding manner, and the reinforcing ribs 1014 are connected to the lower side of the upper stop part 1012. Through the above structure, the reinforcing rib can support the upper stop part, so that the stop strength of the upper stop part is further improved.

In this embodiment, the upper surface of the partition plate part 1011 extends to form several first positioning pillars 1015; first positioning holes 1016 are arranged on the first positioning pillars 1015; an inner surface of the upper side wall extends to form a second positioning pillar 1017; and the second positioning pillar 1017 is inserted into the first positioning holes 1016. The lower surface of the partition plate part 1011 extends to form several third positioning pillars 1018; second positioning holes 1019 are arranged on the third positioning pillars 1018; the inner surface of the upper side wall extends to form a fourth positioning pillar 1020; and the fourth positioning pillar 1020 is inserted into the second positioning holes 1019. Through the above structure, due to the arrangement of the second positioning pillar, the fourth positioning pillar, the first positioning holes, and the second positioning holes, it is convenient for a user to connect the upper side wall and the lower side wall to the first surrounding wall group and cover the upper end and the lower end of the first surrounding wall group, so as to stop the first magnet part at the first compartment part and stop the second magnet part at the second compartment part.

In this embodiment, the supporting wall includes: a first inner wall group 102, wherein the first inner wall group 102 is connected to an inner surface of the first surrounding wall group 101; the first inner wall group 102 and the inner surface of the first surrounding wall group 101 are encircled to form a mounting slot group 103, and the mounting slot group 103 is arranged between the first compartment part and the second compartment part; a second inner wall group 104, wherein the second inner wall group 104 is connected to an inner surface of the upper side wall 25; the second inner wall group 104 and the inner surface of the upper side wall 25 form the first compartment part; the first compartment part is communicated to the mounting slot group 103; and a third inner wall group 105, wherein the third inner wall group 105 is connected to an inner surface of the lower side wall 26; the third inner wall group 105 and the inner surface of the lower side wall 26 form the second compartment part; the second compartment part is communicated to the mounting slot group 103; wherein the partition plate part 1011, the first surrounding wall group 101, the first inner wall group 102, the second inner wall group 104, the third inner wall group 105, the upper stop prat 1012, and the lower stop part 1013 are integrally formed.

In this embodiment, the building block main body 1 is a square building block main body; the square building block main body 1 is provided with six side walls 2, which include a front side wall 21, a rear side wall 22, a left side wall 23, a right side wall 24, an upper side wall 25, and a lower side wall 26; the front side wall 21, the rear side wall 22, the left side wall 23, and the right side wall 24 are connected in sequence to form the first surrounding wall group 101; a right side of the front side wall 21 is connected to the right side wall 24; upper sides of the front side wall 21 and the right side wall 24 are both connected to the upper side wall 25; lower sides of the front side wall 21 and the right side wall 24 are both connected to the lower side wall 26; a left side of the front side wall 21 is connected to the left side wall 23; upper sides of the front side wall 21 and the left side wall 23 are both connected to the upper side wall 25; lower sides of the front side wall 21 and the left side wall 23 are both connected to the lower side wall 26; a left side of the rear side wall 22 is connected to the right side wall 24; upper sides of the rear side wall 22 and the right side wall 24 are both connected to the upper side wall 25; lower sides of the rear side wall 22 and the right side wall 24 are both connected to the lower side wall 26; a right side of the rear side wall 22 is connected to the left side wall 23; upper sides of the rear side wall 22 and the left side wall 23 are both connected to the upper side wall 25; and lower sides of the rear side wall 22 and the left side wall 23 are both connected to the lower side wall 26. The first crossed corner part includes a first crossed corner unit 31 arranged at a joint among the front side wall 21, the right side wall 24, and the upper side wall 25, a third crossed corner unit 33 arranged at a joint among the front side wall 21, the left side wall 23, and the upper side wall 25, a fifth crossed corner unit 35 arranged at a joint among the rear side wall 22, the right side wall 24, and the upper side wall 25, and a seventh crossed corner unit 37 arranged at a joint among the rear side wall 22, the left side wall 23, and the upper side wall 25. The second crossed corner part includes a second crossed corner unit 32 arranged at a joint among the front side wall 21, the right side wall 24, and the lower side wall 26, a fourth crossed corner unit 34 arranged at a joint among the front side wall 21, the left side wall 23, and the lower side wall 26, a sixth crossed corner unit 36 arranged at a joint among the rear side wall 22, the right side wall 24, and the lower side wall 26, and an eighth crossed corner unit 38 arranged at a joint among the rear side wall 22, the left side wall 23, and the lower side wall 26. The first compartment part includes a first compartment unit 41 arranged at the first crossed corner unit 31, a third compartment unit 43 arranged at the third crossed corner unit 33, a fifth compartment unit 45 arranged at the fifth crossed corner unit 35, and a seventh compartment unit 47 arranged at the seventh crossed corner unit 37. The second compartment part includes a second compartment unit 42 arranged at the second crossed corner unit 32, a fourth compartment unit 44 arranged at the fourth crossed corner unit 34, a sixth compartment unit 46 arranged at the sixth crossed corner unit 36, and an eighth compartment unit 48 arranged at the eighth crossed corner unit 38. The first magnet part includes a first magnet unit 51 arranged at the first compartment unit 41, a third magnet unit 53 arranged at the third compartment unit 43, a fifth magnet unit 55 arranged at the fifth compartment unit 45, and a seventh magnet unit 57 arranged at the seventh compartment unit 47. The second magnet part includes a second magnet unit 52 arranged at the second compartment unit 42, a fourth magnet unit 54 arranged at the fourth compartment unit 44, a sixth magnet unit 56 arranged at the sixth compartment unit 46, and an eighth magnet unit 58 arranged at the eighth compartment unit 48. The mounting slot group includes a first mounting slot arranged between the first compartment unit and the second compartment unit, a second mounting slot arranged between the third compartment and the fourth compartment, a third mounting slot arranged between the fifth compartment and the sixth compartment, and a fourth mounting slot arranged between the seventh compartment and the eighth compartment; the stop assembly is a stop pillar assembly 10; the upper stop part 1012 is an upper stop pillar part, and the lower stop part 1013 is a lower stop pillar part; the stop assembly 10 includes a first stop pillar 711, a second stop pillar 712, a third stop pillar 713, and a fourth stop pillar 714; the first stop pillar is arranged in the first mounting slot; the second stop pillar is arranged in the second mounting slot; the third stop pillar is arranged in the third mounting slot; and the fourth stop pillar is arranged in the fourth mounting slot. An upper side of the first stop pillar 711 stops the first magnet unit 51 inside the first compartment unit 41, and a lower side of the first stop pillar 711 stops the second magnet unit 52 inside the second compartment unit 42. An upper side of the second stop pillar 712 stops the third magnet unit 53 inside the third compartment unit 43, and a lower side of the second stop pillar 712 stops the fourth magnet unit 54 inside the fourth compartment unit 44. An upper side of the third stop pillar 713 stops the fifth magnet unit 55 inside the fifth compartment unit 45, and a lower side of the third stop pillar 713 stops the sixth magnet unit 56 inside the sixth compartment unit 46. An upper side of the fourth stop pillar 714 stops the seventh magnet unit 57 inside the seventh compartment unit 47, and a lower side of the fourth stop pillar 714 stops the eighth magnet unit 58 inside the eighth compartment unit 48. Through the above structure, the magnetic building block has a reasonable design, a simple structure, and a stable connection. By the arrangement of the first magnet part and the second magnet part at the first corner unit, the second corner unit, the third corner unit, the fourth corner unit, the fifth corner unit, the sixth corner unit, the seventh corner unit, and the eighth corner unit of the square building block, the various magnetic building blocks can be connected and stacked in a misplaced manner at the corners of the side walls, so as to achieve the design and building of the misplaced shapes.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A magnetic building block, comprising:

a building block main body comprising:

a first surrounding wall group formed by connecting a plurality of surrounding walls end to end in sequence, an inner wall group comprising a plurality of supporting walls integrally formed with an inner side of the surrounding walls, and the surrounding walls and the supporting walls cooperatively form a plurality of compartment parts;

a plurality of elongated stop parts, wherein each of the compartment parts receives one of the stop parts;

a plurality of magnets received in the compartment parts, and each provided with an N pole and an S pole;

an upper side wall connected to an upper end of the first surrounding wall group; and a lower side wall connected to a lower end of the first surrounding wall group;

wherein the upper side wall is spaced apart from the upper end of each of the stop parts to form one upper receiving space between the upper end of each of the stop parts and the upper side wall, and the lower side wall is spaced apart from the lower end of each of the stop parts to form one lower receiving space between the lower end of each of the stop parts and the lower side wall, thereby the stop parts separates the upper receiving space and the lower receiving space, and each of the magnets is received in the upper receiving space or in the lower receiving space, the stop parts allows the magnets positioning adjacent to the upper side wall or the lower side wall and a free rotation in the compartment parts;

wherein the building block main body further comprises a partition plate part connected to the inner side of the surrounding walls, the compartment parts comprise four upper compartment parts located on an upper surface of the partition plate part, and four lower compartment parts located on a lower surface of the partition plate part, the stop parts comprise four upper stop parts received in the respective upper compartment parts, and four lower stop parts received in the respective lower compartment parts, and a length of the upper stop part is greater than a length of the lower stop part.

2. The magnetic building block according to claim 1, wherein the upper surface of the partition plate part extends to form several first positioning pillars; first positioning holes are arranged on the first positioning pillars; an inner surface of the upper side wall extends to form a second positioning pillar; and the second positioning pillar is inserted into the first positioning holes.

3. The magnetic building block according to claim 2, wherein the lower surface of the partition plate part extends to form several third positioning pillars; second positioning holes are arranged on the third positioning pillars; the inner surface of the lower side wall extends to form a fourth positioning pillar; and the fourth positioning pillar is inserted into the second positioning holes.

4. The magnetic building block according to claim 1, wherein the building block main body is a square building block main body; the square building block main body is provided with six side walls.

5. The magnetic building block according to claim 1, wherein the partition plate part, the first surrounding wall group, the supporting walls, the upper stop parts and the lower stop parts are integrally formed.

6. The magnetic building block according to claim 1, wherein the compartment parts are four compartment parts arranged at corners of the building block main body, and extending from the lower end of the first surrounding wall group to the upper end of the first surrounding wall group.

7. The magnetic building block according to claim 1, wherein the stop parts are separated from each other or are connected to a same common component of the building block main body.

8. The magnetic building block according to claim 1, wherein the stop parts are movable in the compartment parts.

* * * * *